US008714125B2

(12) United States Patent
Kamichika

(10) Patent No.: US 8,714,125 B2
(45) Date of Patent: May 6, 2014

(54) VALVE GEAR OF ENGINE

(75) Inventor: Takurou Kamichika, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 84 days.

(21) Appl. No.: 13/500,451

(22) PCT Filed: Oct. 4, 2010

(86) PCT No.: PCT/JP2010/067380

§ 371 (c)(1),
(2), (4) Date: Apr. 5, 2012

(87) PCT Pub. No.: WO2011/043301

PCT Pub. Date: Apr. 14, 2011

(65) Prior Publication Data

US 2012/0204824 A1 Aug. 16, 2012

(30) Foreign Application Priority Data

Oct. 6, 2009 (JP) ..... 2009-232203

(51) Int. Cl.
*F01L 1/18* (2006.01)

(52) U.S. Cl.
USPC ..... 123/90.39; 123/90.16; 123/90.44; 74/559; 74/569

(58) Field of Classification Search
USPC ..... 123/90.16, 90.39, 90.44; 74/559, 569
See application file for complete search history.

(56) References Cited

U.S. PATENT DOCUMENTS

| | | | | |
|---|---|---|---|---|
| 7,409,938 | B2 * | 8/2008 | Dengler | 123/90.18 |
| 2007/0034184 | A1 | 2/2007 | Dengler | |

FOREIGN PATENT DOCUMENTS

| | | | |
|---|---|---|---|
| DE | 197 00 736 | A1 | 7/1998 |
| EP | 2 169 188 | A1 | 3/2010 |
| EP | 2 169 189 | A1 | 3/2010 |
| EP | 2 169 190 | A1 | 3/2010 |
| JP | 58-190507 | A | 11/1983 |
| JP | 63-154437 | A | 6/1988 |
| JP | 2-43004 | B2 | 9/1990 |
| JP | 06-185322 | A | 7/1994 |
| JP | 2001-20710 | A | 1/2001 |
| JP | 3365805 | B2 | 1/2003 |
| JP | 2006-520869 | A | 9/2006 |

OTHER PUBLICATIONS

Official Communication issued in International Patent Application No. PCT/JP2010/067380, mailed on Dec. 7, 2010.

(Continued)

*Primary Examiner* — Ching Chang
(74) *Attorney, Agent, or Firm* — Keating & Bennett, LLP

(57) ABSTRACT

A valve drive system of an engine includes a camshaft that is supported by a cylinder head of the engine and on which a plurality of cams having different valve lift characteristics are arranged at predetermined intervals, a rocker shaft that is supported by the cylinder head so as to be parallel or substantially parallel to the camshaft, and a rocker arm that is swingably supported by the rocker shaft. The rocker arm is arranged between one of the cams and an intake valve or an exhaust valve and is arranged so as to be movable in an axial direction of the rocker shaft. A presser of the rocker arm that presses the intake valve or the exhaust valve extends in the axial direction and has a length greater than an interval between the cams. The valve drive system includes a drive unit that moves the rocker arm toward one side or toward an opposite side in the axial direction by the interval between the cams.

15 Claims, 18 Drawing Sheets

(56) References Cited

OTHER PUBLICATIONS

Official Communication issued in corresponding European Patent Application No. 10821971.8, mailed on Mar. 13, 2013.

English translation of Official Communication issued in corresponding International Application PCT/JP2010/067380, mailed on May 18, 2012.

* cited by examiner

VALVE GEAR OF ENGINE

BACKGROUND OF THE INVENTION

1. Field of the Invention

The present invention relates to a valve gear or valve drive system of an engine, and particularly, to a valve drive system that includes a switching mechanism that performs switching between a plurality of cams having different valve lift characteristics.

2. Description of the Related Art

Conventional techniques for a valve drive system of an engine are disclosed in, for example, Japanese Published Examined Patent Application No. H2-43004, Japanese Patent No. 3365805, and Japanese Translation of International Application No. 2006-520869.

A valve drive system disclosed in Japanese Published Examined Patent Application No. H2-43004 includes a low-speed rocker arm that is pressed by a low-speed cam that is used for a low speed, a high-speed rocker arm that is pressed by a high-speed cam that is used for a high speed, and a switching mechanism that performs switching between the cams to be used. In this valve drive system, an intake valve or an exhaust valve is connected only to the low-speed rocker arm.

The switching mechanism includes a hydraulic piston that moves between the low-speed rocker arm and the high-speed rocker arm. The hydraulic piston is stored in the low-speed rocker arm when the low-speed cam is used. The hydraulic piston is engaged both with the low-speed rocker arm and with the high-speed rocker arm when the high-speed cam is used.

A valve drive system disclosed in Japanese Patent No. 3365805 includes a switching mechanism that performs switching between two kinds of cams. The switching mechanism includes a roller guide supported by a rocker arm so as to be movable in the axial direction thereof, a roller rotatably supported by the roller guide, and a cam mechanism that moves the roller guide in the axial direction. The roller is in contact with either of the two kinds of cams. The cam mechanism includes a rail groove and an annular groove that are formed on a camshaft, a follower pin disposed at the roller guide so as to be able to enter or leave these grooves, and a return spring that returns the roller guide to an initial position. A terminal of the rail groove is connected to the annular groove.

In this valve drive system, the roller guide and the roller move toward one side in the axial direction by allowing the follower pin to move forwardly to be fitted into the rail groove, and one of the two kinds of cams is connected to the rocker arm. On the other hand, the roller guide returns to the initial position while receiving a spring force of the return spring by allowing the follower pin to move backward, and the other one of the two kinds of cams is connected to the rocker arm.

A valve drive system disclosed in Japanese Translation of International Application No. 2006-520869 includes a switching mechanism that moves two cams having different valve lift characteristics in the axial direction of a camshaft. The switching mechanism includes a cam carrier formed of a cylindrical body that has the cams, spiral grooves formed at both ends of the cam carrier, and a pair of driving pins that can be inserted into the spiral grooves, respectively. The cam carrier is supported by a main camshaft that penetrates the cam carrier. The cam carrier rotates together with the main camshaft, and moves toward one side in the axial direction of the main camshaft by allowing one driving pin to be inserted into one spiral groove. On the other hand, the cam carrier moves toward the other side in the axial direction by allowing the other driving pin to be inserted into the other spiral groove.

Each of the rocker arms of the valve drive systems disclosed in Japanese Published Examined Patent Application No. H2-43004 and Japanese Patent No. 3365805 includes the movable member (piston, roller guide) of the switching mechanism. Therefore, these valve drive systems increase in the mass of the rocker arm. Additionally, the rocker arm has a complex structure, and hence has a possibility that a portion of the rocker arm may have a low rigidity. If the rocker arm is great in mass and is low in rigidity, a cam action cannot be reliably transmitted to the intake valve or the exhaust valve during a high-speed operation. In this case, the opening/closing timing and the amount of valve lift may become inaccurate, thus resulting in damage to the valve drive system.

Additionally, the valve drive systems disclosed in Japanese Published Examined Patent Application No. H2-43004 and Japanese Patent No. 3365805 cannot control the moving speed of the movable members (piston, roller guide). Therefore, the movable members moving at a high speed collide with a stopper part, and an impact sound occurs.

The high-speed rocker arm of Japanese Published Examined Patent Application No. H2-43004 is always pressed against the high-speed cam by a lost motion spring. The follower pin of Japanese Patent No. 3365805 is pressed against a side wall of the annular groove by the return spring in a state of having moved to the inside of the annular groove. In other words, in the valve drive systems of Japanese Published Examined Patent Application No. H2-43004 and Japanese Patent No. 3365805, there are components that are pressed against a rotating part on the camshaft side and that are brought into slide contact therewith, and therefore a loss in engine power occurs.

The cam carrier and the main camshaft of the valve drive system of Japanese Translation of International Application No. 2006-520869 are splined to each other. Therefore, the connection structure formed by the cam carrier and the main camshaft is complex, and production costs are high.

In the valve drive system of Japanese Published Examined Patent Application No. H2-43004, Japanese Patent No. 3365805, or Japanese Translation of International Application No. 2006-520869, a switching mechanism is needed for each cam (i.e., each cylinder). Therefore, if the valve drive system is used for a multi-cylinder engine, the number of switching mechanisms becomes larger correspondingly to a rise in the number of cylinders, and production costs become higher.

SUMMARY OF THE INVENTION

In order to solve or lessen the effects of the above-mentioned problems, preferred embodiments of the present invention provide a valve drive system of an engine in which the mass of a rocker arm is significantly reduced. Additionally, preferred embodiments of the present invention provide a valve drive system that prevents the occurrence of an impact sound during switching and that is capable of reducing a power loss. Still additionally, preferred embodiments of the present invention provide a valve drive system of an engine that is low in production costs even if the valve drive system is used for a multi-cylinder engine.

One preferred embodiment of the present invention provides a valve drive system of an engine, and the valve drive system includes a camshaft that is supported by a cylinder head of the engine and on which a plurality of cams having different valve lift characteristics are arranged at a predetermined interval (i.e., pitches), a rocker shaft supported by the cylinder head in parallel or substantially in parallel with the camshaft, and a rocker arm that is swingably supported by the rocker shaft. The rocker arm is provided between one of the plurality of cams and an intake valve or an exhaust valve and is arranged so as to be movable in an axial direction of the rocker shaft. A presser of the rocker arm with respect to the intake valve or the exhaust valve extends in the axial direction with a length greater than the interval (pitch) between the plurality of cams. The valve drive system further includes a drive unit that moves the rocker arm toward one side or toward an opposite side in the axial direction by the interval between the plurality of cams. Preferably, the drive unit is arranged so as to generate a thrust force to move the rocker arm in the axial direction when the amounts of valve lifts of the plurality of cams are 0 while using a switching cam that is preferably integral with the camshaft. Preferably, the drive unit is supported by an element or component that is different from the rocker arm.

A valve drive system according to a preferred embodiment of the present invention preferably has a different structure from those of Japanese Published Examined Patent Application No. H2-43004 and Japanese Translation of International Application No. 2006-520869, and is arranged so that the rocker arm is movable in the axial direction of the rocker shaft. The rocker arm is moved by the drive unit in the axial direction of the rocker shaft. Therefore, the drive unit can be easily supported by an element or component other than the rocker arm. By thus disposing the drive unit, a moving component used to perform switching between cams to be used can be disposed at an element or component that is different from the rocker arm, and therefore the mass of the rocker arm can be reduced. As a result, the rocker arm can be swung at a high speed. Additionally, there is no need to build a cam-switching mechanism into the rocker arm, and therefore the structure of the rocker arm can be made simple, and this makes it possible to increase the rigidity of the rocker arm. As a result, the rocker arm can accurately transmit the operation of the cam to the intake valve or to the exhaust valve.

Additionally, the valve drive system is not arranged so as to move the valve-driving cam of the camshaft in the axial direction. Therefore, the camshaft can be produced without applying processing for moving the valve-driving cam.

Additionally, even when the switching cam is constructed integrally with the camshaft, the camshaft can be more easily manufactured than the structure of Japanese Translation of International Application No. 2006-520869 that uses a spline to perform power transmission and a movement in the axial direction. Therefore, production costs can be significantly reduced.

In one preferred embodiment of the present invention, the drive unit includes a driving mechanism that transforms rotation of the camshaft into a thrust force toward one side or toward an opposite side in the axial direction of the camshaft, a slider that is driven by the driving mechanism to move in the axial direction of the camshaft, a connecting mechanism that connects the slider and the rocker arm, and a holding mechanism that holds the slider at a position to which the slider has moved. Preferably, in this case, the driving mechanism includes a first cam mechanism that moves the slider toward one side in the axial direction when the amounts of valve lifts of the plurality of cams are 0, and a second cam mechanism that moves the slider toward an opposite side in the axial direction when the amounts of valve lifts of the plurality of cams are 0. Preferably, the driving mechanism additionally includes an actuator that performs switching between "use" and "non-use" of the first and second cam mechanisms. Preferably, a movement distance of the slider moved by the first and second cam mechanisms is set to be equal to the interval between the plurality of cams or is set to be a value close to the interval between the plurality of cams.

Additionally, in one preferred embodiment of the present invention, each of the first cam mechanism and the second cam mechanism includes a switching cam that includes a cam groove that has a predetermined depth in a radial direction of the camshaft and that extends in a circumferential direction and in the axial direction of the camshaft, and a cam follower arranged so as to be guided by the switching cam. Preferably, in this case, the actuator is arranged so as to reciprocate the cam followers of the first and second cam mechanisms between a use position at which the cam followers are guided while being in contact with the switching cam and a non-use position at which the cam followers are spaced apart from the switching cam outwardly in the radial direction. Preferably, the slider is supported by a portion of the camshaft at which the switching cam is arranged relatively rotatably with respect to the camshaft, and is held such that rotation around the camshaft is restrained by the connecting mechanism. Preferably, the cam followers of the first and second cam mechanisms are movably supported by the slider.

Preferably, the connecting mechanism is arranged so as to transmit a thrust force from the slider to the rocker arm through the rocker shaft.

In one preferred embodiment of the present invention, each of the switching cams of the first cam mechanism and the second cam mechanism includes a movement groove that includes an inclined portion arranged to move the slider in the axial direction and an annular positioning groove that extends in the circumferential direction of the camshaft at a same position in the axial direction as a terminal of the inclined portion. Preferably, in this case, the holding mechanism includes the positioning groove and the cam follower.

The positioning groove of the first cam mechanism and the positioning groove of the second cam mechanism may be provided at a same position in the axial direction. In other words, one positioning groove may be shared between the first cam mechanism and the second cam mechanism.

Preferably, a depth of the positioning groove is equal to or greater than a depth of the movement groove.

In one preferred embodiment of the present invention, the actuator includes a lifter for each cam follower that is attached to a front end of the cam follower and that is supported so as to enter and leave the slider, a spring member that presses the lifter in a direction in which the lifter leaves the slider, and an actuator body that faces the lifter. Preferably, in this case, the actuator body is supported by a cylinder head or a head cover, and includes a plurality of plungers that proceed to and recede from the lifter.

In one preferred embodiment of the present invention, the rocker shaft includes a first rocker shaft that moves in the axial direction together with the slider and the rocker arm, and a second rocker shaft arranged so as to be located coaxially with the first rocker shaft and so as to be relatively movable in the axial direction with respect to the first rocker shaft. Preferably, the first rocker shaft is joined to the rocker arms corresponding to a plurality of cylinders of the engine so that the thrust force is transmitted thereto. Preferably, the first cam mechanism and the second cam mechanism are arranged so as to generate a thrust force by which the slider is moved when the amounts of valve lifts become 0 in the plurality of cylinders.

In one preferred embodiment of the present invention, the rocker shaft includes an outer rocker shaft that is shaped like a pipe and to which the rocker arm is attached, and an inner rocker shaft that is movably fitted to an inside of the outer rocker shaft. Preferably, in this case, the connecting mechanism is arranged so as to transmit a thrust force from the slider to the rocker arm through the outer rocker shaft. Preferably, the holding mechanism includes a dent located on an outer surface or on an inner surface of the outer rocker shaft, and an in-and-out member that is arranged so as to be able to go in and out of the dent and that is arranged so as to be pressed against the dent by elasticity.

A power source of the actuator may be an electrically-operated driving source, for example. A power source of the actuator may be a hydraulic driving source, for example. Preferably, in either case, the actuator is arranged such that, in an OFF state, one of the first and second cam mechanisms reaches a use state, and a remaining one thereof reaches a non-use state.

The above and other elements, features, steps, characteristics and advantages of the present invention will become more apparent from the following detailed description of the preferred embodiments with reference to the attached drawings.

BRIEF DESCRIPTION OF THE DRAWINGS

FIGS. 7A, 7B, and 7C are graphs showing the crank angle, the amount of valve lift, and the position and depth of each groove of an ordinarily-used in-line four-cylinder engine, wherein FIG. 7A shows a relationship between the crank angle and the amount of valve lift of each cylinder, FIG. 7B shows a relationship among the crank angle, the amount of valve lift of each of first and second cylinders, the position of each groove, and the depth of each groove, and FIG. 7C shows a relationship among the crank angle, the amount of valve lift of each of third and fourth cylinders, the position of each groove, and the depth of each groove.

FIGS. 8A, 8B, and 8C are side views for describing an operation for switching between cams, wherein FIG. 8A shows a state before switching therebetween, FIG. 8B shows a state immediately after the switching operation of an actuator, and FIG. 8C shows a state in which a first cam follower has been inserted in a cam groove.

FIGS. 9A and 9B are side views for describing a cam switching operation, wherein FIG. 9A shows a state in which a slider has started moving, and FIG. 9B shows a state in which the slider has finished moving.

FIGS. 10A and 10B are side views showing a preferred embodiment in which two of four cylinders are brought into a dormant state, wherein FIG. 10A shows a state in which all cylinders are used and operated, and FIG. 10B shows a state in which two cylinders are dormant.

FIGS. 11A and 11B are side views showing a preferred embodiment in which one of two valves that are provided for each cylinder is brought into a dormant state, wherein FIG. 11A shows a state in which all valves are used and operated, and FIG. 11B shows a state in which one of the two valves is dormant.

FIGS. 12A, 12B, and 12C are graphs showing a relationship between the crank angle and the amount of valve lift of a V-type eight-cylinder engine, wherein FIG. 12A shows a relationship therebetween concerning all cylinders, FIG. 12B shows a relationship therebetween concerning cylinders of a first bank, and FIG. 12C shows a relationship therebetween concerning cylinders of a second bank.

FIGS. 13A and 13B are side views showing an example in which only cylinders placed at both ends of a group of four cylinders are brought into a dormant state, wherein FIG. 13A shows a state in which all cylinders are used and operated, and FIG. 13B shows a state in which two cylinders are dormant.

DETAILED DESCRIPTION OF THE PREFERRED EMBODIMENTS

First Preferred Embodiment

A first preferred embodiment of a valve drive system of an engine according to the present invention will be hereinafter described in detail with reference to FIG. 1 to FIG. 9B. The present preferred embodiment is one example in which the present invention is preferably applied to an in-line four-cylinder engine, for example.

Figure 1:
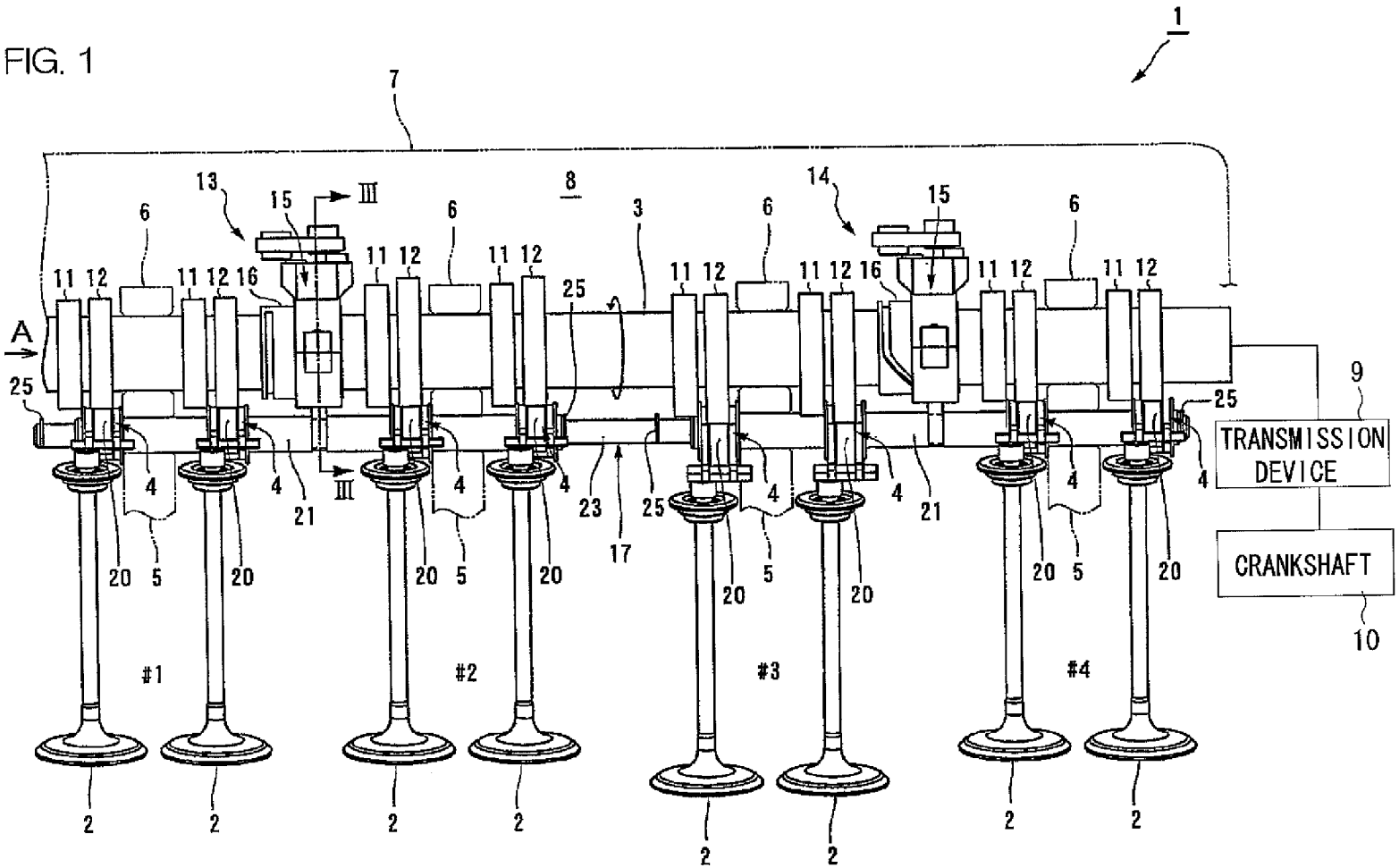
FIG. 1 is a side view showing an arrangement of a valve drive system of an engine according to a preferred embodiment of the present invention.

A valve drive system 1 of an engine shown in FIG. 1 is arranged so as to drive valves 2, two of which are preferably provided for each cylinder, for example, via a camshaft 3 and a rocker arm 4. The valve 2 is an intake valve or an exhaust valve. The valve drive system 1 is applicable to an engine that includes an intake camshaft and an exhaust camshaft. The valve drive system 1 is applicable also to an engine that includes only one camshaft. Therefore, in a description of the present preferred embodiment, no distinction is drawn between members of the intake system and members of the exhaust system.

The engine to which the valve drive system 1 is applied includes two intake valves or two exhaust valves for each cylinder. For convenience, in the description of the present preferred embodiment, a cylinder leftmost in FIG. 1 is referred to as a "first cylinder (#1 cylinder)," a cylinder rightwardly next to the leftmost cylinder is referred to as a "second cylinder (#2 cylinder)," a cylinder rightwardly next to the second cylinder is referred to as a "third cylinder (#3 cylinder)," and a cylinder rightwardly next to the third cylinder is referred to as a "fourth cylinder (#4 cylinder)."

The camshaft 3 shown in FIG. 1 is supported rotatably around its axis by a cylinder head 5 and a cam cap 6.

An end of the camshaft 3 is connected to a crankshaft 10 of the engine through a transmission device 9. The camshaft 3 is contained in a valve drive system chamber 8. The valve drive system chamber 8 is defined between the cylinder head 5 and a head cover 7 attached to the cylinder head 5.

The camshaft 3 includes a plurality of cams, which differ in valve lift characteristics from each other, for each valve 2. These cams include low-speed cams 11 each having a relatively small amount of valve lift and high-speed cams 12 each having a relatively great amount of valve lift. These cams 11 and 12 are arranged at a predetermined interval (pitch) in the axial direction of the camshaft 3. In other words, these cams 11 and 12 are arranged on the outer peripheral surface of the camshaft 3 so as to be adjacent to each other with a predetermined interval (pitch) therebetween.

Figure 2:
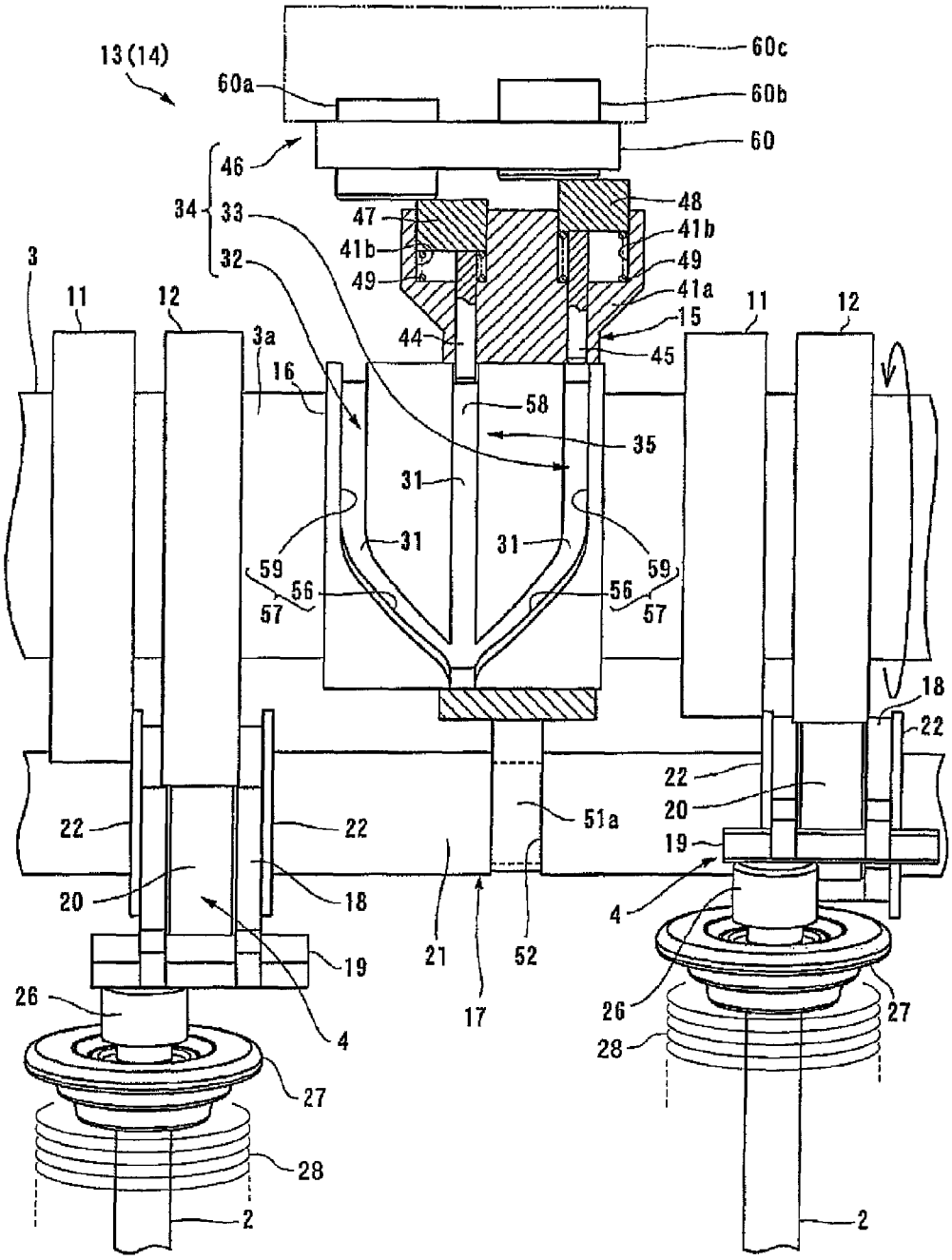
FIG. 2 is an enlarged side view of a main portion of the valve drive system, and shows a slider illustrated in a sectioned state.
Figure 3:
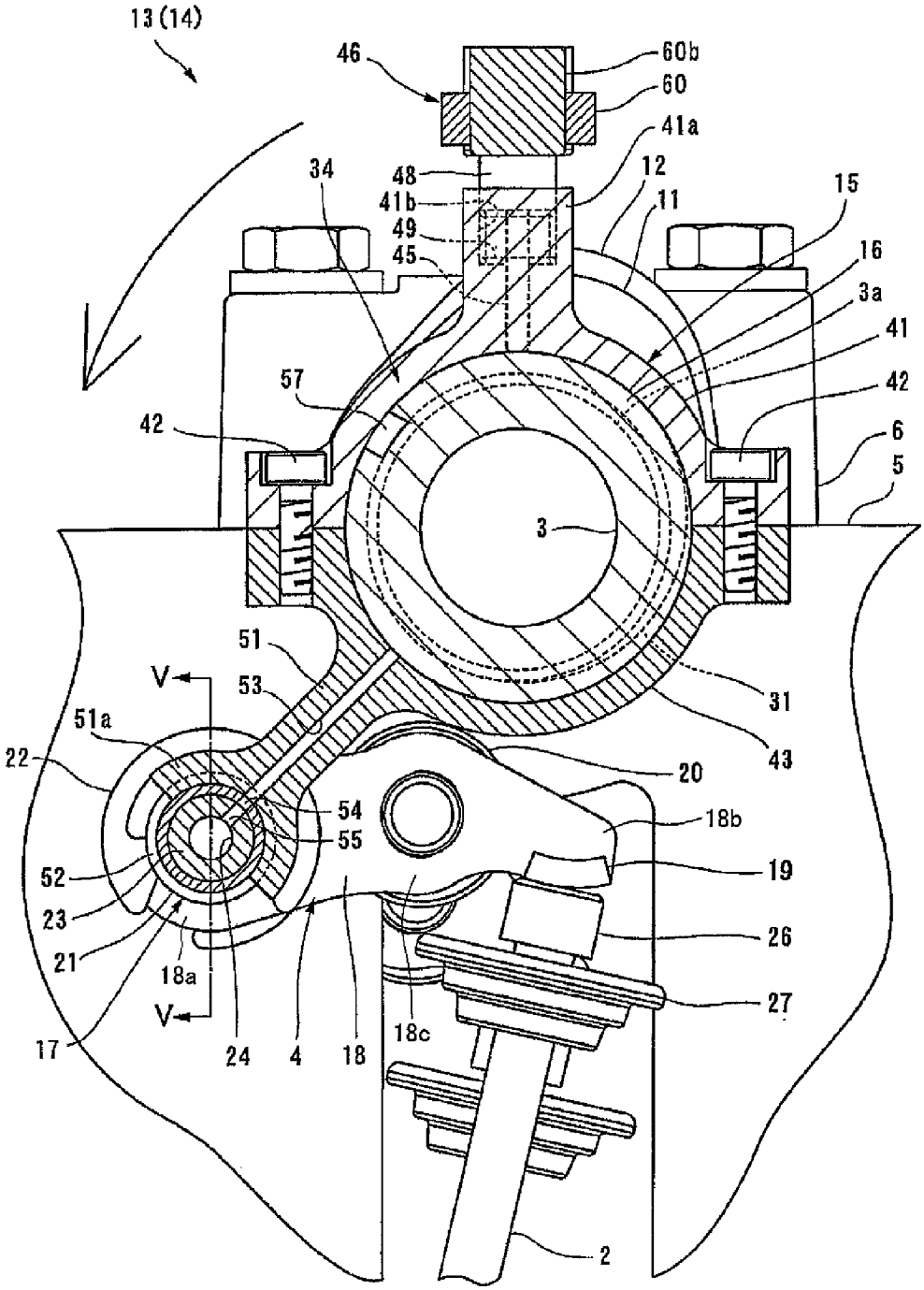
FIG. 3 is a sectional view along line III-III of the main portion of FIG. 1.
Figure 4:
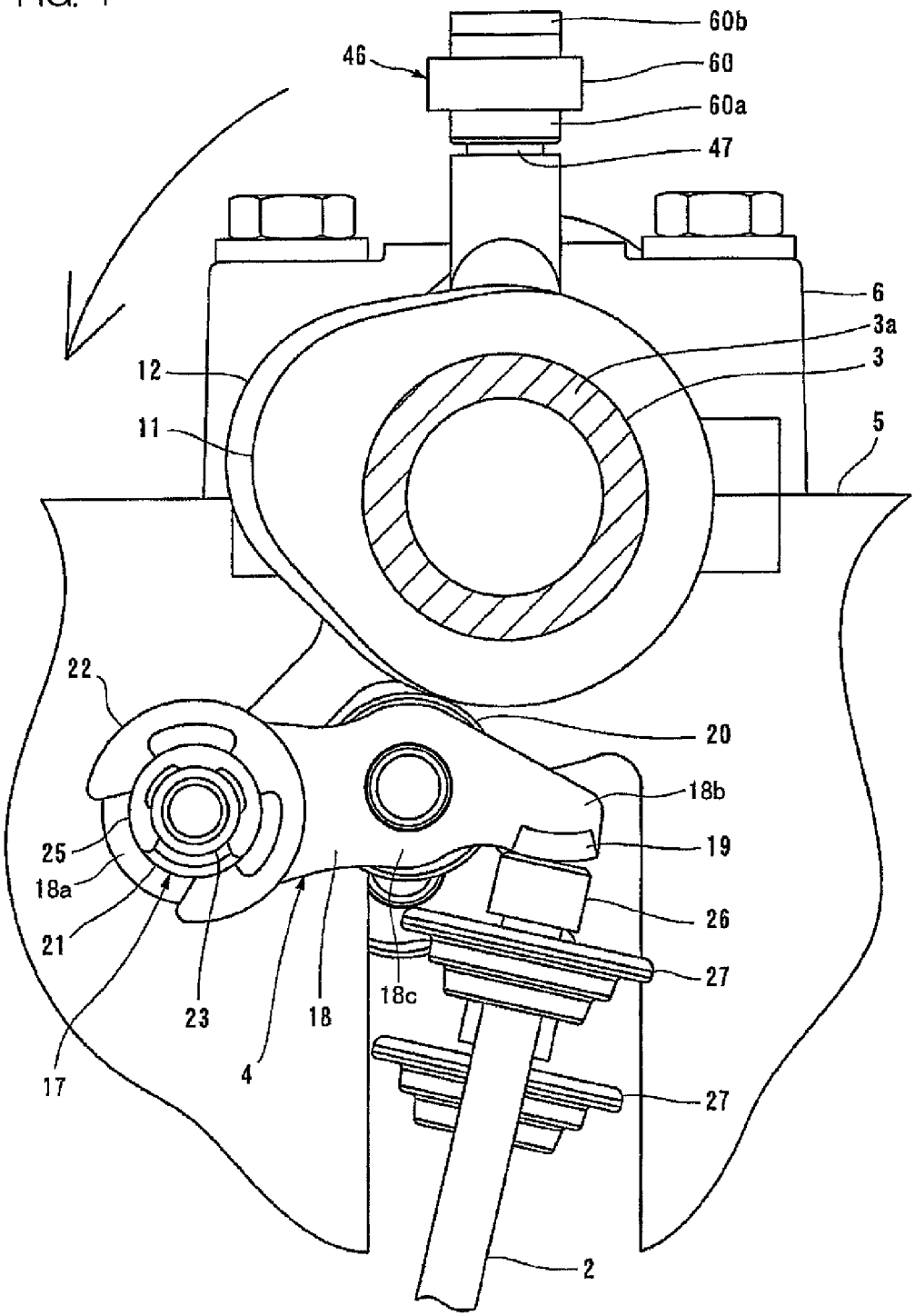
FIG. 4 is a front view of a rocker arm portion shown by arrow "A" of FIG. 1.

In order to support sliders 15 of drive units 13 and 14 described later, the camshaft 3 is preferably provided with two large diameter portions 16. One large diameter portion 16 is disposed between the cams 11 and 12 for the first cylinder and the cams 11 and 12 for the second cylinder. The other large diameter portion 16 is disposed between the cams 11 and 12 for the third cylinder and the cams 11 and 12 for the fourth cylinder. As shown in FIG. 2 and FIG. 3, these two large diameter portions 16 are greater in the outer diameter than a shaft portion 3*a* of the camshaft 3. In the present preferred embodiment, the large diameter portion 16 is preferably formed so as to be integral with the shaft portion 3*a* by integral molding, for example, as best shown in FIG. 3. However, the large diameter portion 16 may be a cylindrical body that is preferably formed integrally with the shaft portion 3*a* by press fitting, for example. In an arrangement formed by pressing and fitting the large diameter portion 16 to the shaft portion 3*a*, the cams 11 and 12 may be members arranged so as to be pressed and fitted to the shaft portion 3*a*.

As shown in FIG. 2 to FIG. 5, the rocker arm 4 includes a rocker arm body 18, a presser 19, and a roller 20. The rocker arm body 18 is swingably supported by a rocker shaft 17 described later. The rocker arm body 18 is arranged so as to rock on the rocker arm shaft 17, and includes a basal end 18*a* joined to the rocker shaft 17 and a swing end 18*b* disposed apart from the rocker arm shaft 17. The presser 19 is disposed integrally with the swing end 18*b* of the rocker arm body 18. The roller 20 is rotatably attached to an intermediate portion 18*c* of the rocker arm body 18.

Figure 5:
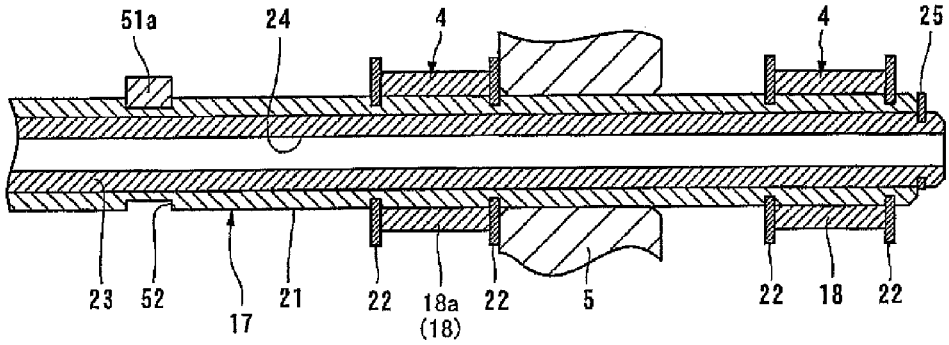
FIG. 5 is a sectional view of a rocker shaft portion at a position shown by line V-V of FIG. 3.

As shown in FIG. 5, the rocker shaft 17 includes an outer rocker shaft 21 shaped like a pipe and an inner rocker shaft 23 that is movably fitted to the outer rocker shaft 21. In other words, the outer rocker shaft 21 is movable with respect to the inner rocker shaft 17 in its axial direction. The basal end 18*a* of the rocker arm body 18 is rotatably joined to the outer rocker shaft 21 (see FIG. 5) of the rocker shaft 17. Furthermore, the basal end 18*a* of the rocker arm body 18 is sandwiched from both sides in the axial direction of the rocker shaft 17 by a pair of E rings 22 attached to the outer rocker shaft 21. In other words, the rocker arm body 18 is joined to the outer rocker shaft 21 so as not to be moved in the axial direction with respect to the outer rocker shaft 21.

An oil passage 24 is defined in the axial center portion of the inner rocker shaft 23. The oil passage 24 is arranged so that oil is supplied from an oil supply passage (not shown) of the cylinder head 5. As shown in FIG. 1 and FIG. 5, in order to restrain the movement of the outer rocker shaft 21, E rings 25 are attached to both ends and an intermediate portion of the inner rocker shaft 23, respectively.

In the present preferred embodiment, the rocker shaft 17 includes one inner rocker shaft 23 and two outer rocker shafts 21 and 21.

As shown in FIG. 1, four rocker arms 4 corresponding to the first and second cylinders #1 and #2 are swingably joined to one of the two outer rocker shafts 21 and 21. On the other hand, four rocker arms 4 corresponding to the third and fourth cylinders #3 and #4 are swingably joined to the other outer rocker shaft 21. These two outer rocker shafts 21 are relatively movable in the axial direction with respect to the inner rocker shaft 23 in a range defined by the E rings 25. Therefore, the outer rocker shaft 21 is supported movably with respect to the cylinder head 5 through the inner rocker shaft 23. In other words, the inner rocker shaft 23 is fixed to the cylinder head 5, and the outer rocker shaft 21 is movably supported on the inner rocker shaft 23. Consequently, the outer rocker shaft 21 is movable in the axial direction thereof while being supported by the cylinder head 5, and the movable range of the outer rocker shaft 21 is defined by the E rings 25 on the inner rocker shaft 23. The rocker arm 4 joined to the outer rocker shaft 21 is therefore movable in the axial direction of the rocker shaft 17 with respect to the cylinder head 5. The rocker arm 4 is arranged so as to be moved in the axial direction by the drive units 13 and 14 (described later) that are disposed at elements or components that are different from the rocker arm 4.

The presser 19 of the rocker arm 4 is arranged so as to press a forward end of the valve 2. A cap-shaped shim 26 and a retainer 27 are attached to the forward end of the valve 2. The valve 2 is pressed in a closing direction (upwardly in FIG. 1) by a valve spring 28 (see FIG. 2) interposed between the retainer 27 and the cylinder head 5.

As shown in FIG. 2, the presser 19 preferably has a shape that extends in the axial direction of the rocker shaft 17. The length in the axial direction of the presser 19 is greater than an interval (pitch) between the low-speed cam 11 and the high-speed cam 12. The interval is a distance between the center in the cam-width direction (axial direction) of the cam 11 and the center in the cam-width direction of the cam 12, i.e., is a formation pitch between the two cams 11 and 12.

The roller 20 of the rocker arm 4 is arranged so as to rotate while being in contact with either of the low-speed cam 11 and the high-speed cam 12. The roller 20 is pressed by the low-speed cam 11 or the high-speed cam 12, and, as a result, the rocker arm 4 rocks on the rocker shaft 17, and depresses the valve 2. In the present preferred embodiment, the width in the axial direction of the roller 20 is equal to or smaller than the width of the low-speed cam 11 or the width of the high-speed cam 12.

The drive units 13 and 14 are arranged so as to move the rocker arm 4 in the axial direction of the rocker shaft 17 so that either of the low-speed cam 11 and the high-speed cam 12 is used. More specifically, the drive units 13 and 14 are arranged so as to move the rocker arm 4 by moving the outer rocker shaft 21 in the axial direction. The drive units 13 and 14 are arranged so as to move the outer rocker shaft 21 in the axial direction when the amount of valve lift is 0 in both the low-speed cam 11 and the high-speed cam 12.

Figure 7A:
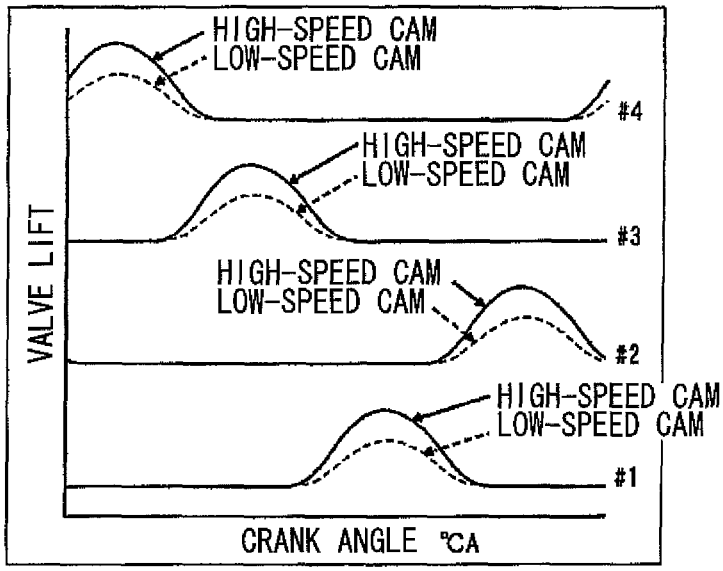

In the valve drive system 1 according to the present preferred embodiment, the amount of valve lift of each cylinder varies as shown in FIG. 7A.

As is understood from FIG. 7A, the amount of valve lift of the second cylinder #2 becomes 0 for a relatively long period when the amount of valve lift is 0 in the first cylinder #1. The amount of valve lift of the fourth cylinder #4 becomes 0 for a relatively long period when the amount of valve lift is 0 in the third cylinder #3. Therefore, the valve drive system 1 according to the present preferred embodiment defines a first group by the first and second cylinders #1 and #2, and defines a second group by the third and fourth cylinders #3 and #4. The rocker arms 4 of the first group are arranged so as to be driven by the drive unit 13, whereas the rocker arms 4 of the second group are arranged so as to be driven by the other drive unit 14.

In more detail, the rocker arms 4 corresponding to the first and second cylinders #1 and #2 are arranged so as to be moved in the axial direction of the rocker shaft 17 by the drive unit 13 as shown in FIG. 1. The drive unit 13 is disposed between the cams 11 and 12 for the first cylinder and the cams 11 and 12 for the second cylinder. The rocker arms 4 corresponding to the third and fourth cylinders #3 and #4 are arranged so as to be moved in the axial direction of the rocker shaft 17 by the drive unit 14. The drive unit 14 is disposed between the cams 11 and 12 for the third cylinder and the cams 11 and 12 for the fourth cylinder.

The drive units 13 and 14 are substantially the same in arrangement although these are different in operation timing. Therefore, a description is provided of the drive unit 13 that moves the rocker arm 4 for the first cylinder and the rocker arm 4 for the second cylinder. The same reference numeral as in the drive unit 13 is given to each corresponding element of the other drive unit 14, and a detailed description of the drive unit 14 is omitted.

Figure 6:
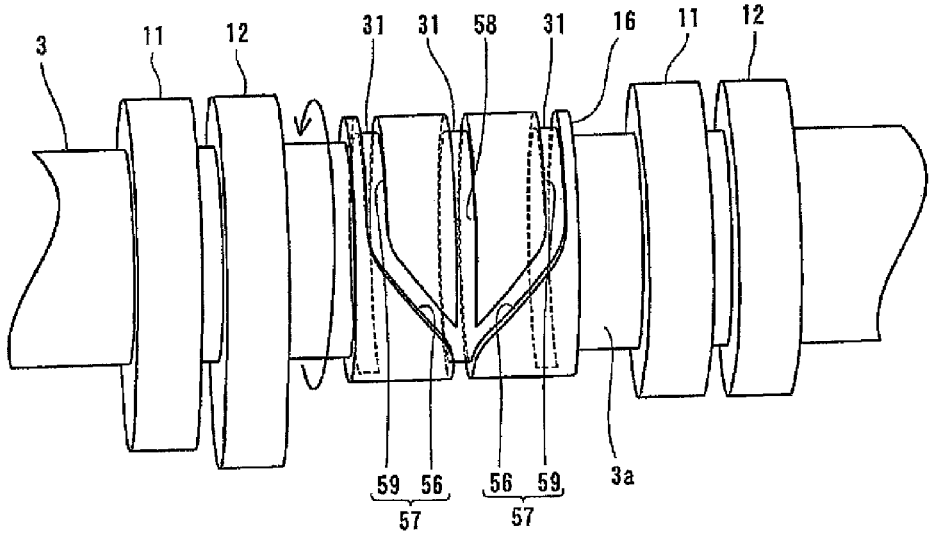
FIG. 6 is a perspective view of a camshaft.

As shown in FIG. 2 and FIG. 6, a switching cam 31 including cam grooves is provided on the large diameter portion 16 of the camshaft 3. The drive unit 13 is arranged so as to generate a thrust force in the axial direction of the camshaft 3 by using the switching cam 31 and so as to move the rocker arm 4 in the axial direction of the rocker shaft 17 by the thrust force. In other words, the drive unit 13 is arranged so as to move the rocker arm 4 toward one side or toward an opposite side in the axial direction of the rocker shaft 17 over a distance equivalent to the interval between the low-speed cam 11 and the high-speed cam 12. Arrows in FIG. 2 and FIG. 6 represent the rotation direction of the camshaft 3.

In the present preferred embodiment, the drive unit 13 preferably includes the slider 15, a driving mechanism 34, the outer rocker shaft 21, and a holding mechanism 35 as shown in FIG. 2 and FIG. 3. The slider 15 is movably supported by the large diameter portion 16 of the camshaft 3. The driving mechanism 34 includes first and second cam mechanisms 32 and 33 that generate the above-mentioned thrust force. The outer rocker shaft 21 defines a connecting mechanism that connects the slider 15 and the rocker arm 4 together. The holding mechanism 35 is arranged so as to hold the slider 15 at a position to which the slider 15 has moved. Arrows in FIG. 2 and FIG. 3 represent the rotation direction of the camshaft 3.

As shown in FIG. 3, the slider 15 includes an upper half portion 41 and a lower half portion 43 attached to the upper half portion 41 with bolts 42. The upper half portion 41 and the lower half portion 43 are rotatably supported by the outer peripheral surface of the large diameter portion 16 in a state of sandwiching the large diameter portion 16 of the camshaft 3 from one side and from an opposite side in a radial direction (i.e., in an up-down direction in FIG. 3). In actual practice, the slider 15 is kept in a non-rotational state when the camshaft 13 rotates, whereas the large diameter portion 16 rotates around its axis between the upper half portion 41 and the lower half portion 43.

A cam follower supporting portion 41*a* that protrudes outwardly in the radial direction of the camshaft 3 is provided on the upper half portion 41. As shown in FIG. 2, the cam follower supporting portion 41*a* supports first and second cam followers 44 and 45, lifters 47 and 48, and a spring member 49. The first and second cam followers 44 and 45 are cylindrical members, respectively, and serve as elements of the first and second cam mechanisms 32 and 33, respectively. The lifters 47 and 48 serve as elements of an actuator 46 (described later) that drive the cam followers 44 and 45. The spring member 49 is arranged so as to press the lifters 47 and 48 in a direction going out from the slider 15 (i.e., outwardly in the radial direction of the camshaft 3).

As shown in FIG. 3, an arm 51 used to connect the slider 15 to the rocker shaft 17 is provided on the lower half portion 43. A forward end 51*a* of the arm 51 is shaped like the capital letter C in the cross section that is opened toward the rocker shaft 17. The forward end 51*a* is fitted into an annular groove 52 of the outer rocker shaft 21. The annular groove 52 is a groove that extends in the circumferential direction of the outer rocker shaft 21. The forward end 51*a* of the arm 51 is joined to the annular groove 52, and, as a result, the slider 15 is prevented from being rotated together with the camshaft 3. In other words, the slider 15 is kept in a non-rotational state when the camshaft 3 rotates.

The forward end 51*a* of the arm 51 is fitted into the annular groove 52 so as not to be moved in the axial direction of the outer rocker shaft 21. Therefore, the slider 15 and the outer rocker shaft 21 move together with each other in the axial direction of the camshaft 3. In the present preferred embodiment, the outer rocker shaft 21 serves as a first rocker shaft that moves together with the slider 15 and the rocker arm 4 in the axial direction. On the other hand, the inner rocker shaft 23 serves as a second rocker shaft that is arranged so as to be located coaxially with the first rocker shaft and so as to be relatively movable in the axial direction with respect to the first rocker shaft.

As shown in FIG. 3, an oil passage 53 is defined in the arm 51. An end of the oil passage 53 is opened toward an inner peripheral surface of the lower half portion 43. The inner peripheral surface of the lower half portion 43 faces the large diameter portion 16. The other end of the oil passage 53 is connected to the oil passage 24 inside the inner rocker shaft 23 through an oil hole 54 of the outer rocker shaft 21 and through an oil hole 55 of the inner rocker shaft 23. In other words, oil supplied to the oil passage 24 inside the inner rocker shaft 23 is guided through the oil holes 54 and 55 and through the oil passage 53 to an area between the slider 15 and the large diameter portion 16, and this area is lubricated with the oil.

As shown in FIG. 2, the driving mechanism 34 includes the first cam mechanism 32, the second cam mechanism 33, and the actuator 46. The first cam mechanism 32 is arranged so as to move the slider 15 toward one side (i.e., rightwardly in FIG. 2) in the axial direction of the rocker arm 17. The second cam mechanism 33 is arranged so as to move the slider 15 toward an opposite side in the axial direction. The actuator 46 is arranged so as to perform switching between use and non-use of the first and second cam mechanisms 32 and 33.

The first cam mechanism 32 includes the switching cam 31 preferably having a groove shape on the large diameter portion 16 and the first cam follower 44 that is engaged with the switching cam 31. Likewise, the second cam mechanism 33 includes the switching cam 31 preferably having a groove shape on the large diameter portion 16 and the second cam follower 45 that is engaged with the switching cam 31.

The switching cam 31 includes a cam groove that extends in the circumferential direction and in the axial direction of the camshaft 3 and that has a depth in the radial direction of the camshaft 3. In more detail, as shown in FIG. 2 and FIG. 6, the switching cam 31 includes a pair of movement grooves 57 and a positioning groove 58. The movement groove 57 has an inclined portion 56 used to move the slider 15 in the axial direction of the camshaft 3. The positioning groove 58 extends over the whole circumference of the camshaft 3 at the same position in the axial direction as the terminal (the lower end in FIG. 2) of the movement groove 57.

In the present preferred embodiment, the positioning groove 58 of the first cam mechanism 32 and the positioning groove 58 of the second cam mechanism 33 are located at the same position in the axial direction of the camshaft 3. In other words, in the driving mechanism 34 according to the present preferred embodiment, one positioning groove 58 is shared between the first cam mechanism 32 and the second cam mechanism 33. However, the positioning groove 58 of the first cam mechanism 32 and the positioning groove 58 of the second cam mechanism 33 may be cam grooves differing from each other that are spaced out in the axial direction of the camshaft 3.

In the present preferred embodiment, the holding mechanism 35 is arranged by the positioning groove 58 and the first and second cam followers 44 and 45.

As shown in FIG. 2 and FIG. 6, each of the two movement grooves 57 includes a linear portion 59 that extends in the circumferential direction of the camshaft 3 and the inclined portion 56 that is inclined with respect to the circumferential direction. Each movement groove 57 preferably has a non-annular shape in which one end of the linear portion 59 is used as a start end 57A and in which one end of the inclined portion 56 is used as a terminal 57B. The inclined portion 56 is inclined so as to be gradually displaced in the axial direction of the camshaft 3 correspondingly to progress in the circumferential direction. The inclined portion 56 of the first cam mechanism 32 and the inclined portion 56 of the second cam mechanism 33 are inclined in mutually opposite directions.

The first and second cam followers 44 and 45 are arranged so as to be engaged with the switching cam 31. The first and second cam followers 44 and 45 are supported by the cam follower supporting portion 41*a* of the slider 15 so as to be movable in the radial direction of the camshaft 3. The first and second cam followers 44 and 45 are arranged so as to be moved by the actuator 46 inside the slider 15.

The first and second cam followers 44 and 45 are arranged so as to reciprocate between a use position and a non-use position by being driven by the actuator 46. The use position is a position at which the cam followers 44 and 45 are fitted to the switching cam 31 defined by the cam grooves. The non-use position is a position at which the cam followers 44 and 45 are spaced apart from the switching cam 31 outwardly in the radial direction of the camshaft 3.

When the camshaft 3 rotates in a state in which one of the first and second cam followers 44 and 45 is located at the use position and has entered the movement groove 57, the one cam follower is guided by the inclined portion 56 of the switching cam 31. As a result, the slider 15 moves toward one side or toward an opposite side in the axial direction of the camshaft 3. An interval between the positioning groove 58 and the linear portion 59 of the movement groove 57 is set so that the movement distance of the slider 15 reaches an interval between the low-speed cam 11 and the high-speed cam 12 or reaches a value close to this interval.

Figure 7B:
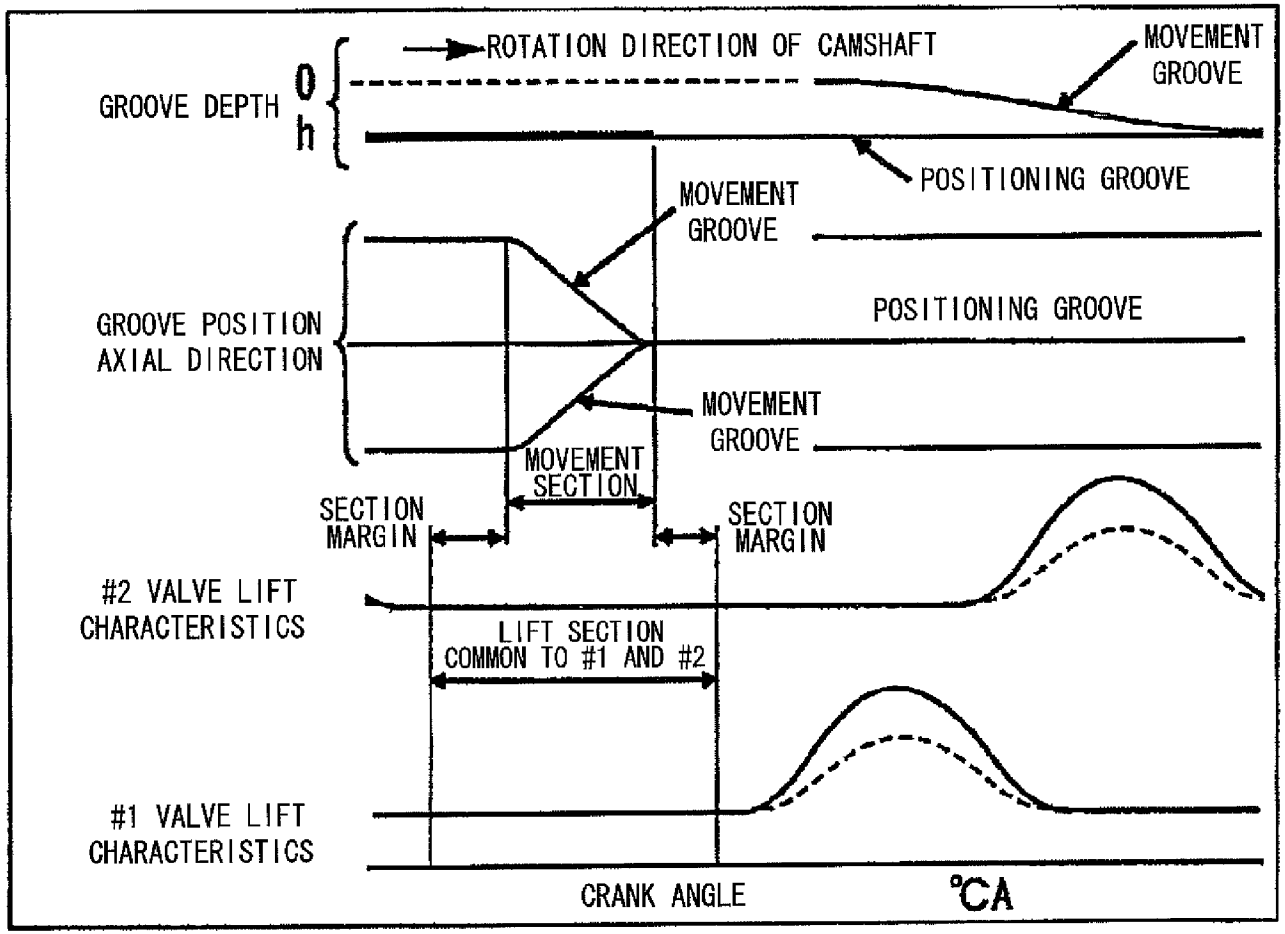

The movement groove 57 (especially, the inclined portion 56) of the first cam mechanism 32 and the movement groove 57 (especially, the inclined portion 56) of the second cam mechanism 33 are located at the same position with respect to the circumferential direction of the camshaft 3 (the large diameter portion 16). As shown in FIG. 7B, the position in the circumferential direction of the camshaft 3 at which the movement grooves 57 (especially, inclined portions 56) are located is a position at which the amount of valve lift of the cam for the first cylinder #1 and the amount of valve lift of the cam for the second cylinder #2 both become 0. In other words, the first and second cam followers 44 and 45 pass along the movement groove 57 (especially, inclined portion 56) in a common 0-lift section of the first and second cylinders #1 and #2 shown in FIG. 7B.

Therefore, the slider 15 is arranged so as to move in the axial direction of the camshaft 3 when the roller 20 of the rocker arm 4 faces a basic circle portion of the low-speed/high-speed cams 11 and 12 (i.e., a location at which the amount of valve lift becomes 0). In the present preferred embodiment, as shown in FIG. 7B, a period (section margin) is provided during which the amount of valve lift becomes 0 by a predetermined crank angle before and after a period (movement section) during which the slider 15 moves.

As shown in the depth of the groove of FIG. 7B, the movement groove 57 is preferably configured so as to gradually become deeper in proportion to progress in the direction in which the camshaft 3 rotates and so as to finally have the same depth as the positioning groove 58. The depth of the positioning groove 58 is preferably configured so as to be constant over the whole circumference. However, it is possible for the depth of the positioning groove 58 to be greater than the depth of the movement groove 57. In other words, it is possible to form the depth so that $0<h1(h2)\leq h$ where h1 and h2 are the depths of the terminals of both movement grooves 57, and h is the depth of the positioning groove 58.

Figure 7C:
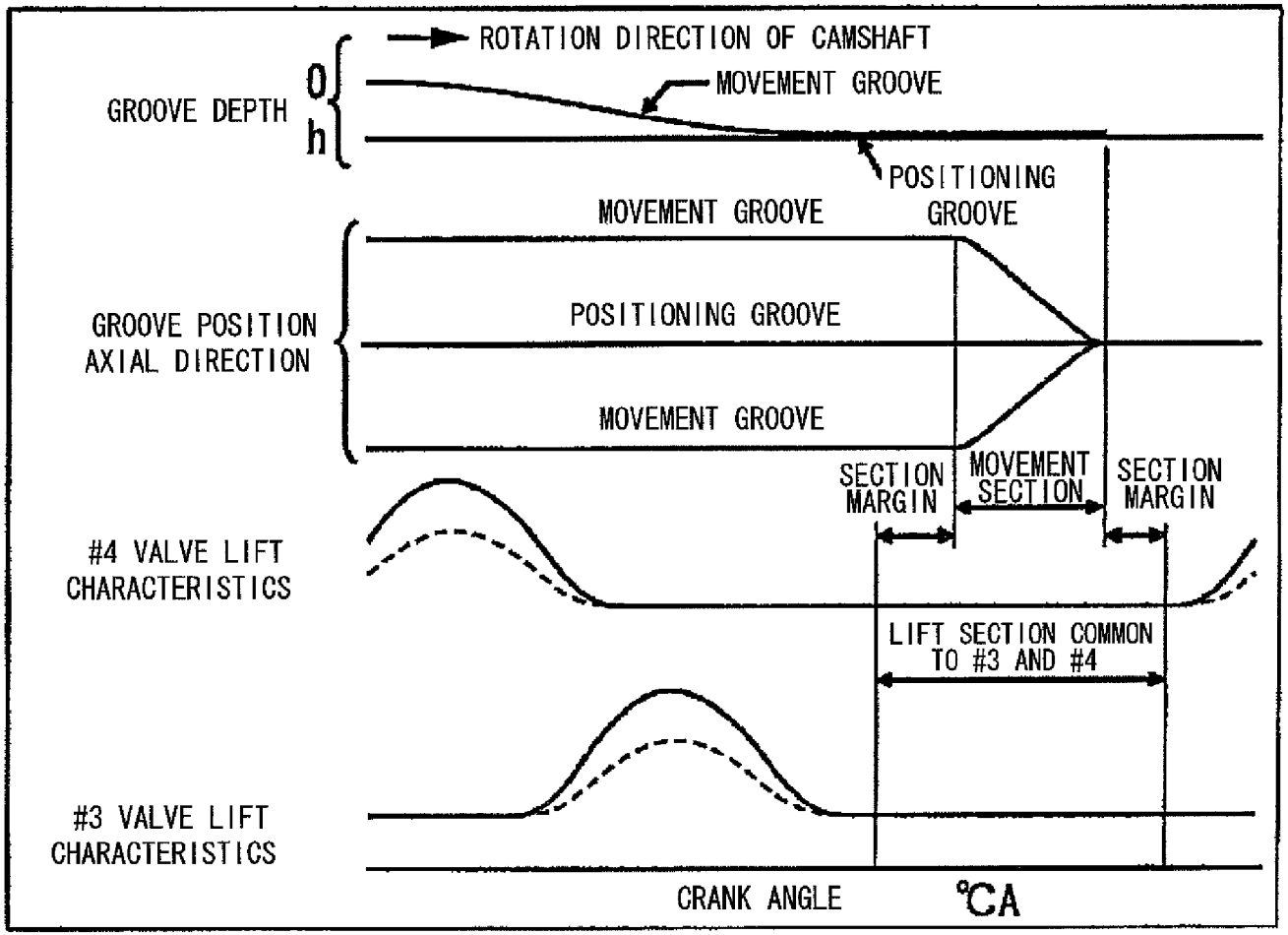

On the other hand, the drive unit 14 for the third and fourth cylinders #3 and #4 is arranged so that the slider 15 moves in a common 0-lift section between the third cylinder #3 and the fourth cylinder #4 as shown in FIG. 7C.

The first and second cam followers 44 and 45 are arranged so as to be driven by the actuator 46. As shown in FIG. 2, the actuator 46 includes the first and second lifters 47 and 48, the spring member 49, and an actuator body 60. The first and second lifters 47 and 48 are attached to the front ends of the first and second cam followers 44 and 45, respectively. A pair of spring members 49 are provided correspondingly to the lifters 47 and 48, and press the lifters 47 and 48 against the actuator body 60. The actuator body 60 is disposed so as to face the lifters 47 and 48.

The first and second lifters 47 and 48 are shaped to be cylindrical, and are movably fitted to a pair of circular holes 41*b* formed in the slider 15, respectively. The forward ends of the lifters 47 and 48 protrude outwardly from the slider 15. In the present preferred embodiment, the spring members 49 are compression coil springs, and are disposed between the lifter 47 and the slider 15 and between the lifter 48 and the slider 15 (the bottom surface of the circular hole 41*b*), respectively.

The actuator body 60 preferably includes first and second plungers 60*a* and 60*b* that are cylindrical and that face the lifters 47 and 48, respectively, and a solenoid 60*c* that drives the plungers 60*a* and 60*b*. The actuator body 60 is supported by the cylinder head 5 or the head cover 7.

The first and second plungers 60*a* and 60*b* are allowed to proceed to or recede from the corresponding lifters 47 and 48 by being driven by the solenoid 60*c*. The lifters 47 and 48 are pressed by the corresponding spring members 49 and, as a result, are brought into contact with the plungers 60*a* and 60*b*, respectively.

The solenoid 60*c* is arranged so as to allow one of the plungers 60*a* and 60*b* to proceed and allow the other one to recede in an OFF state that is a non-excitation state. In other words, the actuator 46 is arranged so that one of the first and second cam mechanisms 32 and 33 reaches a use state, whereas the other one reaches a non-use state in an OFF state.

In the actuator 46, when the slider 15 moves toward one side or toward an opposite side in the axial direction of the camshaft 3, the lifters 47 and 48 move while being in contact with the plungers 60*a* and 60*b*. The outer diameters and the installation intervals (pitches) of both of the lifters 47 and 48 and the outer diameters and the installation intervals (pitches) of both of the plungers 60*a* and 60*b* are set so that the lifters 47 and 48 never come off from the plungers 60*a* and 60*b* when the slider 15 moves. Additionally, the outer diameters and the installation intervals (pitches) of these components are set so that the first lifter 47 comes into contact with only the first plunger 60*a* and so that the second lifter 48 comes into contact with only the second plunger 60*b*.

The operation of the valve drive system 1 arranged in this way will be described with reference to FIGS. 8A to 8C and FIGS. 9A and 9B. Herein, a description is given of the operation thereof when switching is performed from a state of using the low-speed cam 11 to a state of using the high-speed cam 12.

Figure 8A:
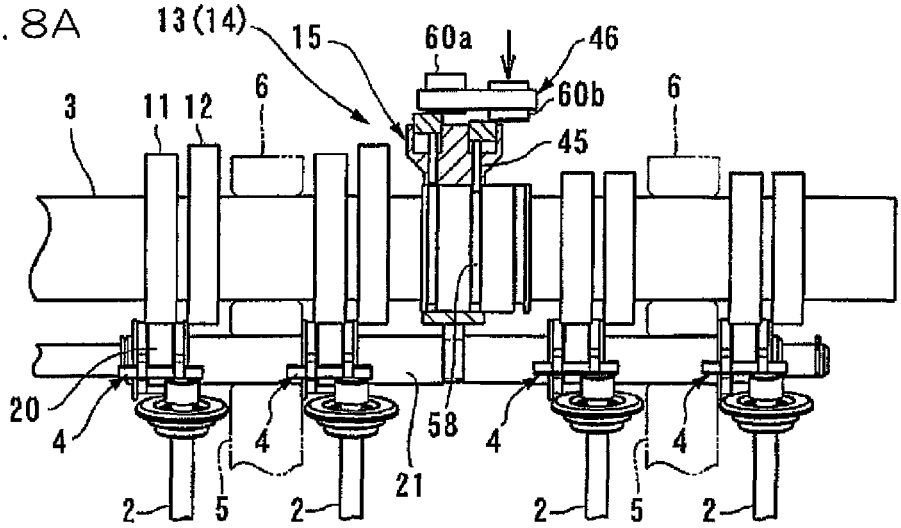
Figure 8B:
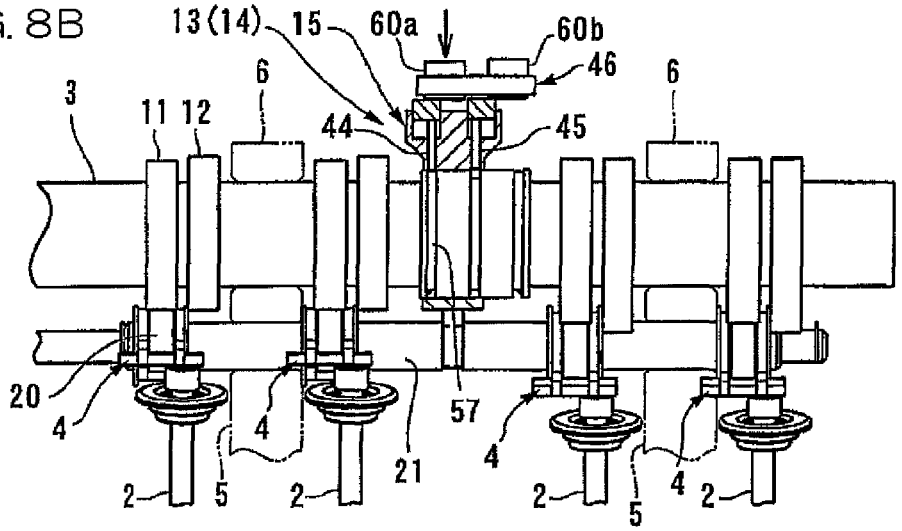

As shown in FIG. 8A, when the low-speed cam 11 is used, the second plunger 60*b* of the actuator 46 moves forwardly, and the second cam follower 45 is inserted in the positioning groove 58. In order to allow the high-speed cam 12 to be used from this state, the second plunger 60*b* is first of all retreated by the actuator 46. As a result of the retreat of the second plunger 60*b*, the second cam follower 45 is moved to the non-use position by the force of the spring member 49.

Thereafter, the first plunger 60*a* is advanced by the actuator 46. As a result of the advancement of the first plunger 60*a*, the first cam follower 44 is pressed toward the use position. At this time, there are a case in which the first cam follower 44 directly enters the movement groove 57 of the first cam mechanism 32 and a case in which the first cam follower 44 presses an outer peripheral surface of the large diameter portion 16 that is located upstream of the movement groove 57 in the rotation direction. In the latter case, the first cam follower 44 goes into the linear portion 59 of the movement groove 57 from the start end by the rotation of the camshaft 3 (see FIG. 8B).

Figure 8C:
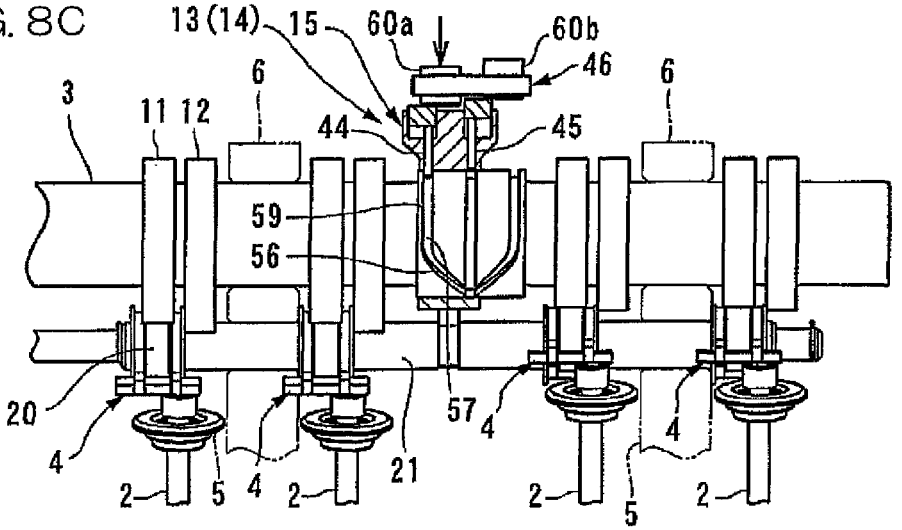
Figure 9A:
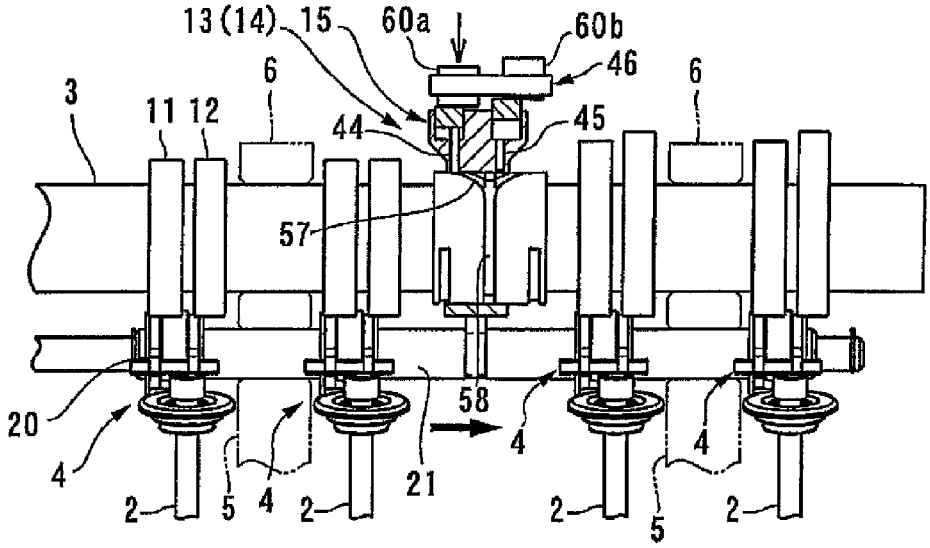

As shown in FIG. 8C and FIG. 9A, the rotation of the camshaft 3 enables the first cam follower 44 to advance from the linear portion 59 of the cam 31 to the inclined portion 56 in the movement groove 57. The first cam follower 44 is pressed by the cam 31 toward one side (rightwardly in FIG. 9A) in the axial direction of the camshaft 3 when passing along the inclined portion 56. In response to the pressing of the first cam follower 44 in this way, the slider 15 moves in the direction in which the first cam follower 44 is pressed. As a result, the outer rocker shaft 21 and the rocker arm 4 move in the same direction together with the slider 15.

Figure 9B:
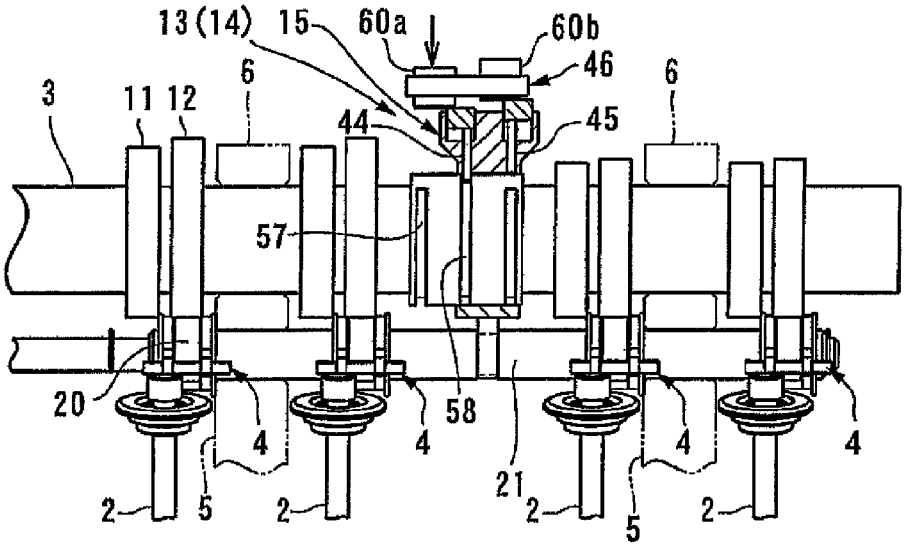

Thereafter, the first cam follower 44 enters the inside of the positioning groove 58 from the inclined portion 56 as shown in FIG. 9B. As a result of the entrance of the first cam follower 44 into the positioning groove 58, the high-speed cam 12 presses the roller 20 of the rocker arm 4, and the switching operation between the cams 11 and 12 is completed. Additionally, it becomes impossible for the slider 15 to move in the axial direction of the camshaft 3.

On the other hand, when switching of the cams to be used from the high-speed cam 12 to the low-speed cam 11 is performed, the first plunger 60*a* of the actuator 46 is retreated, and the second plunger 60*b* is advanced. As a result, the same operation as above is performed. In detail, the first cam follower 44 is retreated to the non-use position, whereas the second cam follower 45 is pressed toward the use position, and enters the inside of the movement groove 57 of the second cam mechanism 33. The second cam follower 45 advances from the linear portion 59 of the cam 31 to the inclined portion 56 in the movement groove 57 by the rotation of the camshaft 3. The second cam follower 45 is pressed toward one side in the axial direction of the camshaft 3 (leftwardly in FIG. 8A) by the cam 31 when passing along the inclined portion 56. In response to the pressing of the second cam follower 45 in this way, the slider 15 moves in the direction in which the second cam follower 45 is pressed. As a result, the outer rocker shaft 21 and the rocker arm 4 move in the same direction together with the slider 15. Thereafter, the second cam follower 45 enters the inside of the positioning groove 58 from the inclined portion 56. As a result of the entrance of the second cam follower 45 into the positioning groove 58, the low-speed cam 11 presses the roller 20 of the rocker arm 4, and the switching operation between the cams 11 and 12 is completed. Additionally, it becomes impossible for the slider 15 to move in the axial direction of the camshaft 3.

In the present preferred embodiment, the rocker arm 4 is moved in the axial direction of the rocker shaft 17 by being driven by the drive units 13 and 14 that are disposed at portions or elements differing from the rocker arm 4, and faces either of the low-speed cam 11 and the high-speed cam 12. As described above, the moving components that perform switching between the cams to be used are disposed at portions or elements differing from the rocker arm 4, and therefore it is possible to restrain an increase in mass of the rocker arm 4.

Therefore, it becomes possible for the rocker arm 4 to rock at a high speed. Additionally, the rocker arm 4 does not have a switching mechanism that performs switching between cams to be used, and therefore designing can be easily performed to form a structure having a high rigidity. Therefore, the rocker arm 4 can accurately transmit the operation of the low-speed cam 11 or the high-speed cam 12 to the valve 2.

The valve drive system 1 according to the present preferred embodiment is not arranged so as to move the valve-driving cams of the camshaft 3 in the axial direction. Therefore, the camshaft 3 can be produced without applying processing for moving the low-speed cam 11 or the high-speed cam 12. Additionally, the movement groove 57 (the switching cam 31) of the camshaft 3 can be formed more easily than a spline used to perform power transmission and movement in the axial direction.

Therefore, the valve drive system 1 according to the present preferred embodiment uses the camshaft 3 that is easily produced, and hence can be produced at a relatively low cost.

Additionally, in the present preferred embodiment, the drive unit 13 preferably includes the driving mechanism 34, the slider 15, and the connecting mechanism (the outer rocker shaft 21). The driving mechanism 34 preferably includes the first cam mechanism 32, the second cam mechanism 33, and the actuator 46. The movement distance of the slider 15 moved by the first and second cam mechanisms 32 and 33 is set to be equal to or be close to the interval (pitch) between the cams 11 and 12.

In the drive units 13 and 14 arranged in this way, switching between the movement and the stopping of the rocker arm 4 in the axial direction is performed by the first and second cam mechanisms 32 and 33.

In other words, in the valve drive system 1 according to the present preferred embodiment, a rigid body never collides with another rigid body by moving in the axial direction of the camshaft 3 when switching between the valve-driving cams 11 and 12 is performed. Therefore, the rocker arm 4 smoothly moves in the axial direction of the camshaft 3. When switching between the low-speed cam 11 and the high-speed cam 12 is performed, an impact sound never occurs, or is remarkably low even if such an impact sound occurs.

In the present preferred embodiment, the first cam mechanism 32 and the second cam mechanism 33 of the driving mechanism 34 include the switching cams 31 and the first and second cam followers 44 and 45, respectively. The actuator 46 is arranged so as to reciprocate the first and second cam followers 44 and 45 between the use position and the non-use position. The slider 15 is rotatably supported by the large diameter portion 16 of the camshaft 3, and its rotation is restrained by the rocker shaft 17. The first and second cam followers 44 and 45 are movably supported by the slider 15.

Therefore, the slider 15 moves in the axial direction of the rocker shaft 17 while being supported by the camshaft 3 and the rocker shaft 17. In other words, the direction in which the slider 15 moves is restrained by the camshaft 3 and the rocker shaft 17 that are the existing members.

Therefore, in the valve drive system 1 according to the present preferred embodiment, the number of components becomes smaller than in an arrangement in which a dedicated guide member is used to restrain the direction in which the slider 15 moves, and production costs can be made smaller.

In the present preferred embodiment, a connecting mechanism arranged so as to transmit a thrust force from the slider 15 to the rocker arm 4 through the outer rocker shaft 21 is provided. As shown in FIG. 1, the outer rocker shaft 21 can support the rocker arms 4 corresponding to a plurality of cylinders together. In other words, the thrust force of the drive unit 13 is transmitted to the rocker arms 4 corresponding to a plurality of cylinders through the outer rocker shaft 21.

Therefore, in the valve drive system 1 according to the present preferred embodiment, switching between the cams 11 and 12 for a plurality of cylinders can be performed by the single drive unit 13. As a result, if the valve drive system 1 is applied to a multi-cylinder engine, production costs can be made lower than a valve drive system required to have a drive unit for each cylinder.

Additionally, in the present preferred embodiment, each switching cam 31 of the first and second cam mechanisms 32 and 33 includes the movement groove 57 and the positioning groove 58. The first and second cam followers 44 and 45 that are engaged with these grooves are guided to the positioning groove 58 after passing along the movement groove 57. The movement of the slider 15 in the axial direction of the camshaft 3 is restrained by the positioning groove 58 and the first and second cam followers 44 and 45 inserted in the positioning groove 58.

Therefore, a load in the axial direction is not needed to restrain the movement in the axial direction of the slider 15, the outer rocker shaft 21, and the rocker arm 4 after performing switching between the cams 11 and 12. As a result, a slide loss can be prevented, and therefore the power loss of the engine can be made small. Additionally, the number of components can be reduced, and the valve drive system can be made small in size by sharing the mechanisms used for the movement and the positioning of the slider 15.

Additionally, in the present preferred embodiment, the positioning groove 58 of the first cam mechanism 32 and the positioning groove 58 of the second cam mechanism 33 are located at the same position with respect to the axial direction of the camshaft 3. Therefore, the drive unit 13 is made small in the axial direction of the camshaft 3. The reason is that the first cam mechanism 32 and the second cam mechanism 33 are disposed close to each other in the axial direction of the camshaft 3 by making the positioning grooves 58 common thereto.

In the present preferred embodiment, the depth of the positioning groove 58 is equal to or is greater than the depth of the movement groove 57. If the positioning groove 58 is deeper than the movement groove 57, the front ends of the first and second cam followers 44 and 45 can be prevented from pressing the groove bottom of the positioning groove 58 toward the axial center of the camshaft 3. Therefore, in this case, the power loss of the engine becomes even smaller.

In the present preferred embodiment, the actuator 46 includes the lifters 47 and 48 for each cam follower, the spring member 49, and the actuator body 60. The actuator body 60 is supported by the cylinder head 5 or the head cover 7, and preferably includes the plurality of plungers 60*a* and 60*b* that advance to and retreat from the lifters 47 and 48, respectively.

According to the present preferred embodiment, the weight of the actuator body 60 that is a power source of the actuator 46 never acts on the slider 15, and is supported by the cylinder head 5 or the head cover 7.

Therefore, an inertia force that occurs when the slider 15 moves in the axial direction of the camshaft 3 becomes smaller than in a case in which the actuator body 60 is supported by the slider 15. Therefore, according to the present preferred embodiment, an impact sound does not occur even if the slider 15 moves at a high speed.

The actuator body 60 is fixed to the cylinder head 5 or to the head cover 7 so as not to be moved. Therefore, according to the present preferred embodiment, the actuator 46 is stably supported, and therefore a high reliability is achieved when the actuator 46 operates.

The power source of the actuator 46 according to the present preferred embodiment is an electrically-operated driving source that uses the solenoid 60*c*. Therefore, a hydraulic passage is not needed, and the capacity of an oil pump may be smaller than in a case in which oil pressure is used as the power source of the actuator 46. This makes it possible to achieve a reduction in cost and in weight.

Additionally, in the present preferred embodiment, the actuator 46 is arranged such that, in an OFF state, one of the first and second cam mechanisms 32 and 33 reaches a use state, and the other one reaches a non-use state. Therefore, when the power of the actuator 46 is lost, the slider 15 is kept in a state of having moved toward one side in the axial direction of the crankshaft 3. Therefore, in the valve drive system 1 according to the present preferred embodiment, the slider 15 does not move needlessly, and switching between the cams 11 and 12 is not performed needlessly even if the power of the actuator 46 is lost.

Additionally, in the present preferred embodiment, the rocker shaft 17 has a dual structure including the outer rocker shaft 21 and the inner rocker shaft 23. Therefore, the rocker shaft 17 has a high rigidity. As a result, the operation of the valve-driving cams (the low-speed cam 11 and the high-speed cam 12) is transmitted to the intake valve or to the exhaust valve through the rocker arm 4 even more accurately.

Second Preferred Embodiment

The valve drive system of the present invention can be used to perform switching an active cam for an operating state and a dormant cam for a dormant state. A preferred embodiment including this arrangement will be described in detail with reference to FIGS. 10A and 10B and FIGS. 11A and 11B. In these figures, the same reference numeral is given to the same or equivalent member as in FIG. 1 to FIG. 9B, and a detailed description of the same or equivalent member is omitted.

Figure 10A:
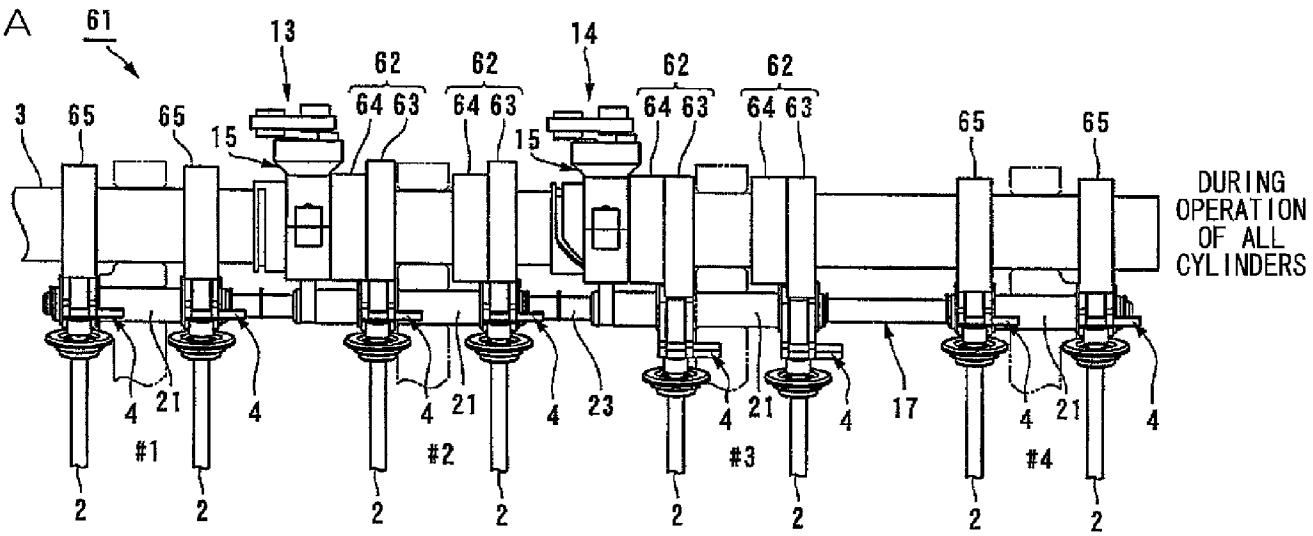
Figure 10B:
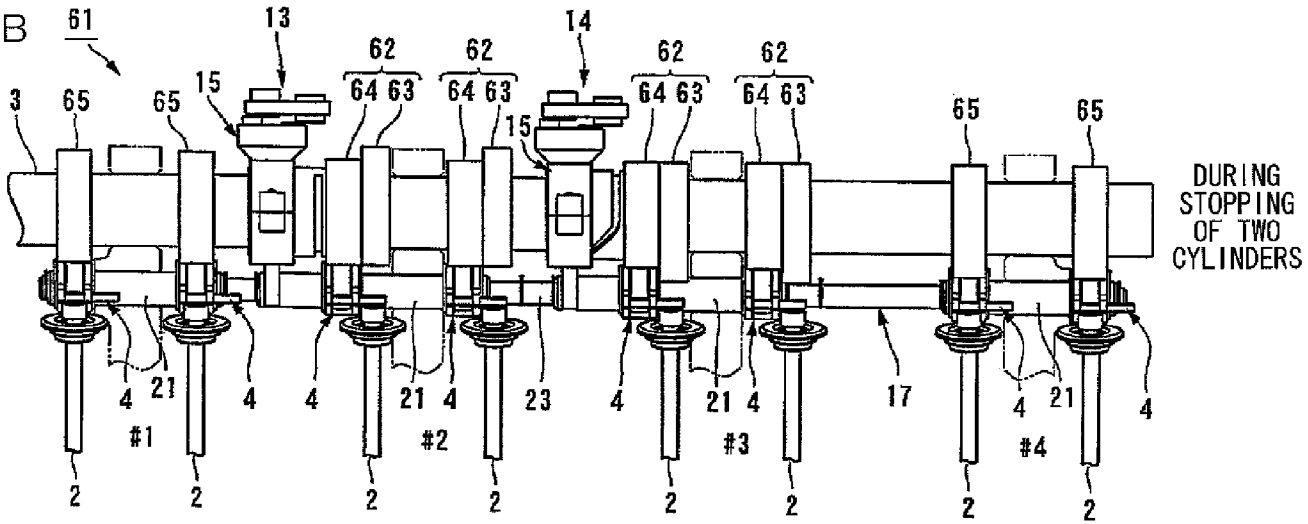
Figure 11A:
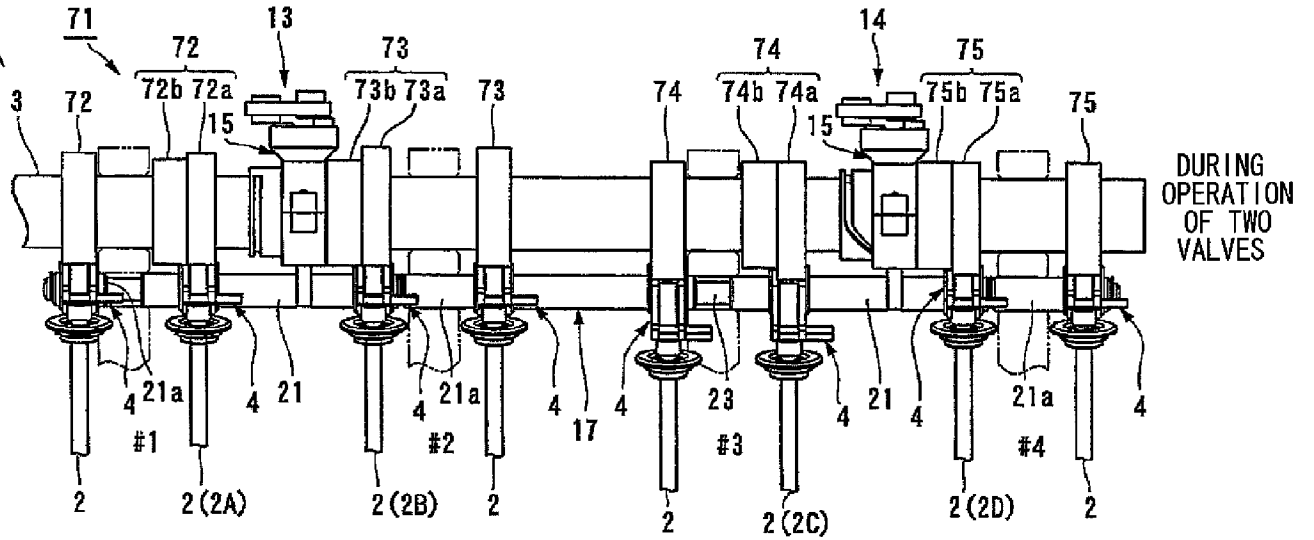
Figure 11B:
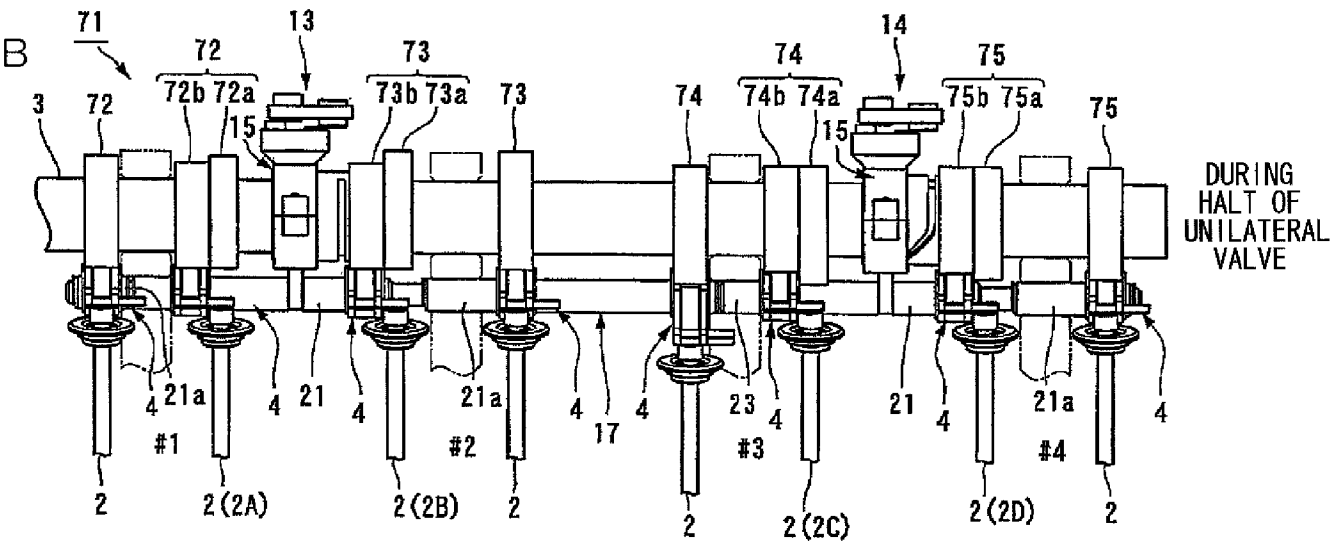

The valve drive system 61 shown in FIGS. 10A and 10B preferably includes a drive unit 13 that performs switching between cams 62 for the second cylinder #2 and a drive unit 14 that performs switching between cams 62 for the third cylinder #3. The cams 62 for the second and third cylinders #2 and #3 include active cams 63 and dormant cams 64, respectively.

With respect to the first cylinder #1 and the fourth cylinder #4, only the active cams 65 are provided, and the dormant cams are not provided. The active cams 63 provided correspondingly to the second and third cylinders #2 and #3 are each arranged so as to have the same shape that differs in phase from that of each cam 65 for the first and fourth cylinders #1 and #4.

The dormant cam 64 preferably has a disk shape that has the same diameter as the basic circle portion of the active cam 63 in which the amount of valve lift becomes 0. In other words, the dormant cam 64 is arranged so that the amount of valve lift becomes 0 without depending on the rotation angle (phase) of the crankshaft 3.

The valve drive system 61 according to the present preferred embodiment is arranged so as to perform switching between the active cam 63 and the dormant cam 64 in the cams to be used. An engine having this valve drive system 61 preferably is a four-cylinder engine when the active cam 63 is used (see FIG. 10A).

On the other hand, when the rocker arm 4 is moved to a position corresponding to the dormant cam 64 by being driven by the drive units 13 and 14, the valve 2 is kept in a closed state in the second cylinder #2 and the third cylinder #3. Therefore, the second cylinder #2 and the third cylinder #3 reach a dormant state (see FIG. 10B). In other words, in this state, fuel efficiency can be improved because the four-cylinder engine substantially becomes a two-cylinder engine.

The valve drive system 71 of FIG. 11 is arranged so as to perform switching between "active" and "dormant" concerning one of two valves 2 per cylinder. The drive unit 13 of the two drive units 13 and 14 that is located between the cams 72 for the first cylinder #1 and the cams 73 for the second cylinder #2 is arranged so as to perform switching between "active" and "dormant" of the two valves 2. One valve for which switching is performed is a valve 2A of the two valves 2 of the first cylinder #1 that is closer to the second cylinder #2. Another valve for which switching is performed is a valve 2B of the two valves 2 of the second cylinder #2 that is closer to the first cylinder #1.

The drive unit 14 that is located between the cams 74 for the third cylinder #3 and the cams 75 for the fourth cylinder #4 is arranged so as to perform switching between "active" and "dormant" of another two valves. One valve for which switching is performed is a valve 2C of the two valves 2 of the third cylinder #3 that is closer to the fourth cylinder #4. Another valve for which switching is performed is a valve 2D of the two valves 2 of the fourth cylinder #4 that is closer to the third cylinder #3.

The valve 2 for which switching between "active" and "dormant" is performed is hereinafter referred to as the "switching valve 2A, 2B, 2C, or 2D."

The cams 72 to 75 corresponding to the switching valves 2A to 2D include active cams 72*a* to 75*a* and dormant cams 72*b* to 75*b*, respectively.

The active cams 72*a* to 75*a* each preferably has the same shape that differs in phase from the cams 72 to 75 that drive the valve 2 that is a valve for which switching between "active" and "dormant" is not performed.

The dormant cams 72*b* to 75*b* are each formed in a disk shape that has the same diameter as the basic circle portion of each of the active cams 72*a* to 75*a* in which the amount of valve lift becomes 0. In other words, the dormant cams 72*b* to 75*b* each have a structure such that the amount of valve lift becomes 0.

The rocker arm 4 corresponding to each of the switching valves 2A to 2D is connected to the slider 15 of the drive unit 13 through the outer rocker shaft 21. The rocker arm 4 corresponding to the valve 2 that is a valve for which switching between "active" and "dormant" is not performed is supported by a fixed-type outer rocker shaft 21*a* constructed to be structurally independent of the outer rocker shaft 21. This fixed-type outer rocker shaft 21*a* is held by the cylinder head 5 and the inner rocker shaft 23 so as not to be moved in the axial direction.

In the engine including the valve drive system 71 of FIG. 11, switching can be performed between a normal operation mode in which two valves 2 are opened and closed in each cylinder and a unilateral valve dormant mode in which only one valve 2 is opened and closed in each cylinder.

When the intake valve is driven while using the valve drive system 71, a swirl can be generated in a combustion chamber (not shown) by choosing the unilateral valve dormant mode. The reason is that intake air is inhaled only from one of two intake ports in each cylinder, and the flow velocity of intake air flowing through the intake port rises.

Third Preferred Embodiment

Figure 12A:
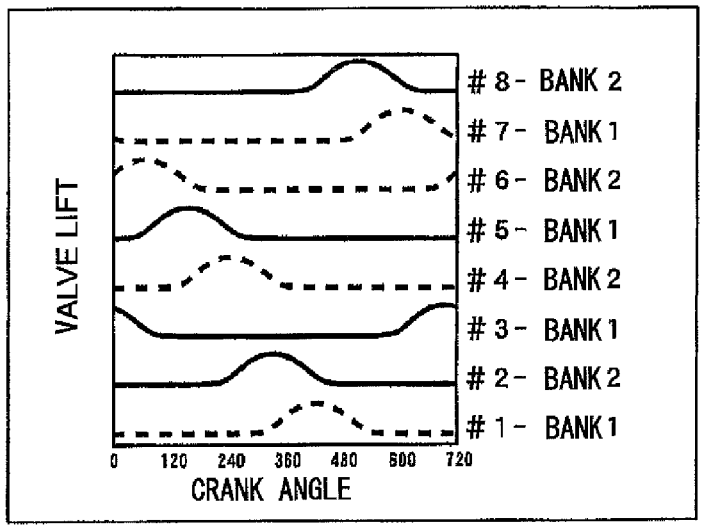
Figure 12B:
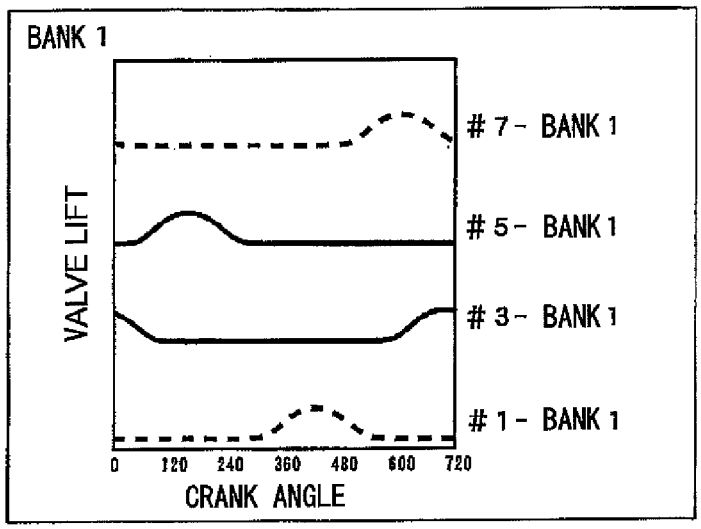
Figure 12C:
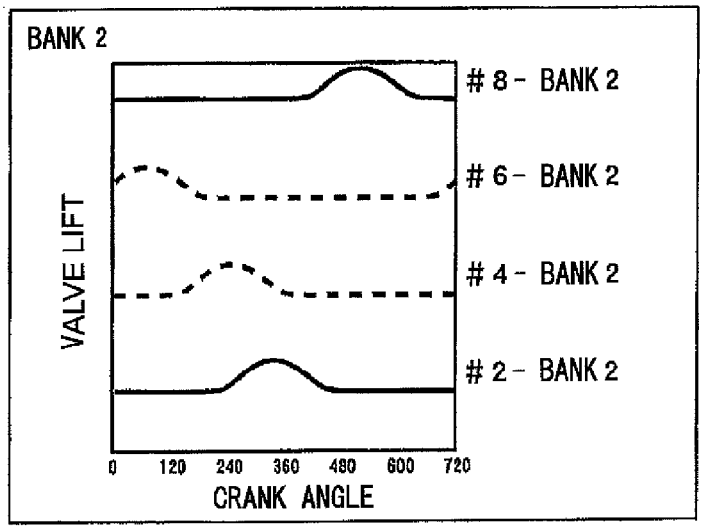
Figure 13A:
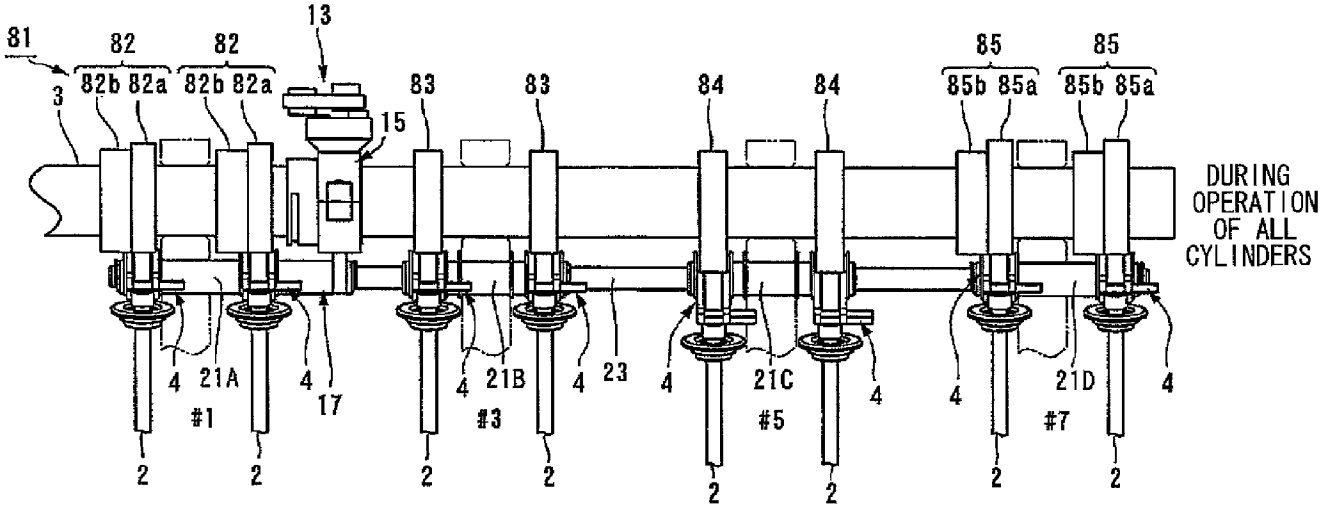
Figure 13B:
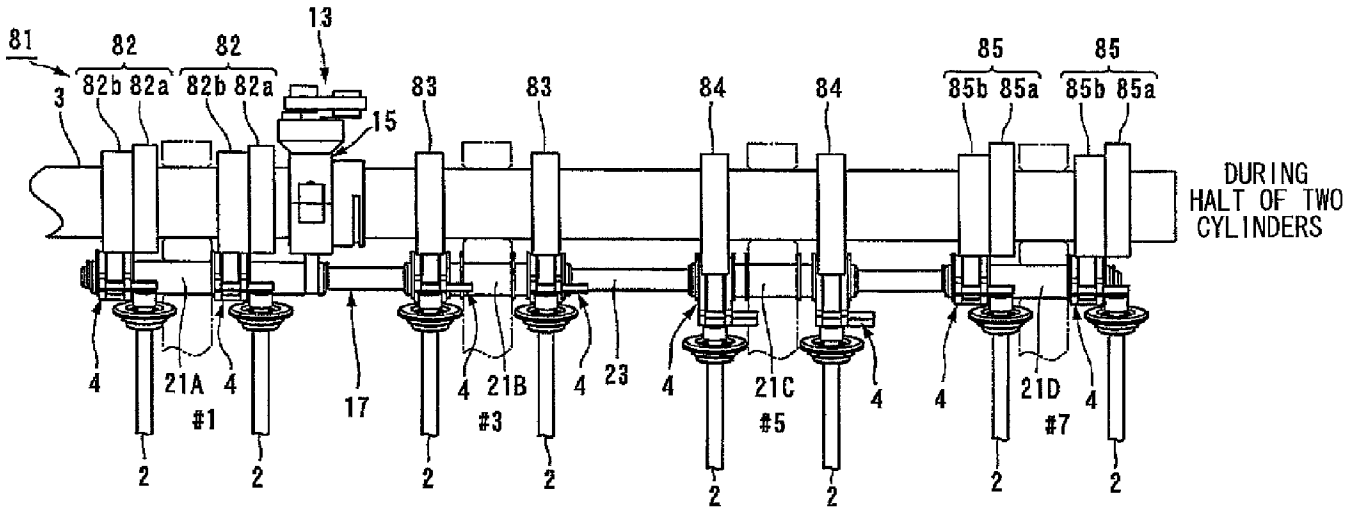

The valve drive system of the present invention can be used in a V-type eight-cylinder engine, for example. A preferred embodiment of the valve drive system applicable to the V-type eight-cylinder engine will be described in detail with reference to FIGS. 12A to 12C and FIGS. 13A and 13B. In FIGS. 13A and 13B, the same reference numeral is given to the same or equivalent member as in FIG. 1 to FIG. 9B, and a detailed description of the same or equivalent member is omitted.

The valve drive system 81 (see FIGS. 13A and 13B) according to the present preferred embodiment is arranged so as to perform switching between operation modes of the V-type eight-cylinder engine. One operation mode is a mode in which the V-type eight-cylinder engine is used as a V-type eight-cylinder engine. Another operation mode is a mode in which the V-type eight-cylinder engine is used substantially as a V-type four-cylinder engine by decreasing the number of driven cylinders. The V-type eight-cylinder engine has two cylinder rows each of which includes four cylinders, and these two cylinder rows are arranged in a V shape. FIGS. 13A and 13B show a valve drive system used for one cylinder row of the V-type eight-cylinder engine.

The V-type eight-cylinder engine includes first to eighth cylinders arranged along a direction from one end to an opposite end of a crankshaft. In general, one cylinder row (hereinafter, this cylinder row is referred to as "bank 1") of the V-type eight-cylinder engine includes a first cylinder #1, a third cylinder #3, a fifth cylinder #5, and a seventh cylinder #7 as shown in FIG. 12A and FIG. 12B. The other bank (bank 2) includes a second cylinder #2, a fourth cylinder #4, a sixth cylinder #6, and an eighth cylinder #8 as shown in FIG. 12C.

This V-type eight-cylinder engine is ignited generally in the following order.

First cylinder #1→Eighth cylinder #8→Seventh cylinder #7→Third cylinder #3→Sixth cylinder #6→Fifth cylinder #5→Fourth cylinder #4→Second cylinder #2.

In order to bring cylinders into a dormant state in this V-type eight-cylinder engine, it is preferable to choose a dormant cylinder so as to bring expansion strokes into equal intervals. The reason is that the occurrence of vibrations resulting from the worsening of rotation balance is prevented.

In order to bring expansion strokes into equal intervals, it is necessary to make the cylinders dormant alternately in the ignition order.

A first cylinder group that has an alternate ignition order includes the first cylinder #1, the fourth cylinder #4, the sixth cylinder #6, and the seventh cylinder #7. A second cylinder group that has an alternate ignition order includes the second cylinder #2, the third cylinder #3, the fifth cylinder #5, and the eighth cylinder #8. In order to perform switching between the operation modes, switching between "operating" and "halt" must be performed in cylinders that belong to one of the first and second cylinder groups.

Cylinders that belong to the first cylinder group in bank 1 are the first cylinder #1 and the seventh cylinder #7 as shown in FIG. 12B. Cylinders that belong to the first cylinder group in bank 2 are the fourth cylinder #4 and the sixth cylinder #6 as shown in FIG. 12C. In FIGS. 12A, 12B, and 12C, the valve lift curve of the cylinders of the first cylinder group is shown by the broken line, whereas the valve lift curve of the cylinders of the second cylinder group is shown by the solid line.

When switching between "operating" and "halt" of cylinders of a V-type engine is performed by the valve drive system according to a preferred embodiment of the present invention, it is preferable to provide only one drive unit in each bank in order to achieve cost reductions.

In order to perform switching between "operating" and "halt" of the cylinders of the first cylinder group, switching between "operating" and "halt" of the first cylinder #1 and the seventh cylinder #7 located at both ends in a direction in which the cylinders are arranged is required to be performed by one drive unit in bank 1. Switching between "operating" and "halt" of the fourth cylinder #4 and the sixth cylinder #6 that are adjacent to each other is required to be performed by one drive unit 13 in bank 2.

Switching between "operating" and "halt" of the fourth cylinder #4 and the sixth cylinder #6 in bank 2 can be performed by the same arrangement as the valve drive system 1 shown in FIGS. 1 to 9B because these cylinders are adjacent to each other.

However, switching between "operating" and "halt" of the first cylinder #1 and the seventh cylinder #7 in bank 1 cannot be performed by the valve drive system 1 shown in the above preferred embodiment. The reason is that other cylinders exist between the first cylinder #1 and the seventh cylinder #7. This applies to a case in which switching between "operating" and "halt" of the cylinders of the second cylinder group is performed. In other words, as shown in FIG. 12C, switching between "operating" and "halt" of the eighth cylinder #8 and the second cylinder #2 of the second cylinder group cannot be performed by the valve drive system 1 shown in FIGS. 1 to 9B.

Therefore, the present preferred embodiment provides an arrangement in which a thrust force is transmitted by taking advantage of the rocker shaft 17 as shown in FIGS. 13A and 13B.

In the present preferred embodiment, the rocker shaft 17 includes outer rocker shafts 21A to 21D and an inner rocker shaft 23 that penetrates the axial center portions of the outer rocker shafts 21A to 21D. The outer rocker shaft 21A is used for the first cylinder #1, and the slider 15 of the drive unit 13 is connected to the outer rocker shaft 21A. The outer rocker shaft 21B is used for the third cylinder #3. The outer rocker shaft 21C is used for the fifth cylinder #5. The outer rocker shaft 21D is used for the seventh cylinder #7.

The outer rocker shaft 21A for the first cylinder #1 is movable in the axial direction together with the two rocker arms 4 of the first cylinder #1. The outer rocker shaft 21D for the seventh cylinder #7 is movable in the axial direction together with the two rocker arms 4 of the seventh cylinder #7. The outer rocker shaft 21B for the third cylinder #3 and the outer rocker shaft 21C for the fifth cylinder #5 are attached to the cylinder head 5 such that these shafts cannot move in their axial directions.

The inner rocker shaft 23 is connected to the outer rocker shaft 21A for the first cylinder #1 and to the outer rocker shaft 21D for the seventh cylinder #7 so as not to be moved in its axial direction. The inner rocker shaft 23 movably penetrates the axial center portions of the outer rocker shaft 21B for the third cylinder #3 and the axial center portion of the outer rocker shaft 21C for the fifth cylinder #5.

In other words, the rocker shaft 17 is arranged so that a thrust force is transmitted to the outer rocker shaft 21D for the seventh cylinder #7 through the inner rocker shaft 23 from the outer rocker shaft 21A for the first cylinder #1 to which the slider 15 of the drive unit 13 is connected.

In the present preferred embodiment, the outer rocker shaft 21A for the first cylinder #1, the outer rocker shaft 21D for the seventh cylinder #7, and the inner rocker shaft 23 preferably define the first rocker shaft. The first rocker shaft is arranged so as to move in the axial direction together with the slider 15 and the rocker arm 4. Additionally, in the present preferred embodiment, the outer rocker shaft 21B for the third cylinder #3 and the outer rocker shaft 21C for the fifth cylinder #5 preferably define the second rocker shaft. The second rocker shaft is arranged so as to be located coaxially with the first rocker shaft and so as to be relatively movable in the axial direction with respect to the first rocker shaft.

Cams 82 and 85 of the first and seventh cylinders #1 and #7 include active cams 82*a* and 85*a* and dormant cams 82*b* and 85*b*, respectively.

The active cams 82*a* and 85*a* are arranged so as to have the same shape that differs in phase from the cam 83 of the third cylinder #3 and the cam 84 of the fourth cylinder #4.

The dormant cams 82*b* and 85*b* each preferably have a disk shape that has the same diameter as the basic circle portion of each of the active cams 82*a* and 85*a* in which the amount of valve lift becomes 0. In other words, the dormant cams 82*b* and 85*b* are arranged so that the amount of valve lift becomes 0 without depending on the rotation angle (phase) of the crankshaft 3.

In the present preferred embodiment, the first cylinder #1 and the seventh cylinder #7 of bank 1 can be switched by the drive unit 13 from an operating state to a dormant state, and the fourth cylinder #4 and the sixth cylinder #6 of bank 2 can be switched by a drive unit (not shown) from an operating state to a dormant state. As a result, the V-type eight-cylinder engine can be operated substantially as a V-type four-cylinder engine. Even if an arrangement in which switching between "operating" and "halt" is performed is employed in the cylinders of the second cylinder group, the same effect can be obtained.

In the present preferred embodiment, the rocker arm 4 for the first cylinder #1 and the rocker arm 4 for the seventh cylinder #7 that are supported by the first rocker shaft receive a thrust force transmitted from the drive unit 13. On the other hand, the rocker arm 4 for the third cylinder #3 and the rocker arm 4 for the fifth cylinder #5 that are supported by the second rocker shaft do not receive the thrust force transmitted therefrom. Therefore, according to the present preferred embodiment, the degree of freedom concerning the choice of cylinders that perform switching between cams becomes high in the multi-cylinder engine.

In other words, in the valve drive system 81 according to the present preferred embodiment, the rocker arms 4 of the plurality of cylinders that are not adjacent to each other can be driven by the single drive unit 13.

Further, in the present preferred embodiment, the rocker shaft 17 has a dual structure, and therefore the rigidity of the rocker shaft 17 is heightened. Therefore, the operation of the valve-driving cams 82 to 84 is accurately transmitted to the intake valve or to the exhaust valve through the rocker arm 4.

Fourth Preferred Embodiment

Figure 14:
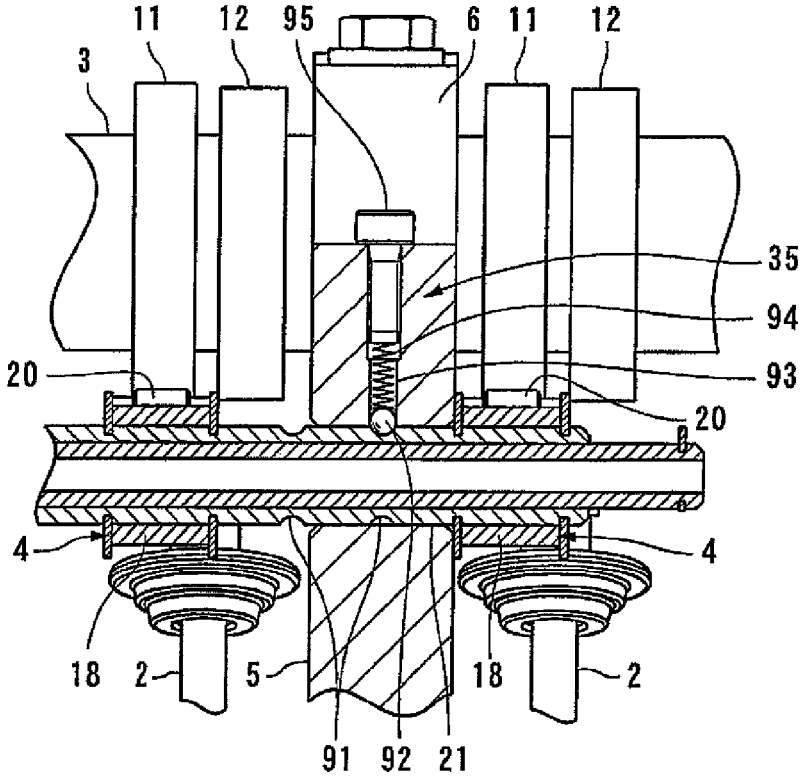
FIG. 14 is a sectional view showing another preferred embodiment of a holding mechanism.
Figure 15:
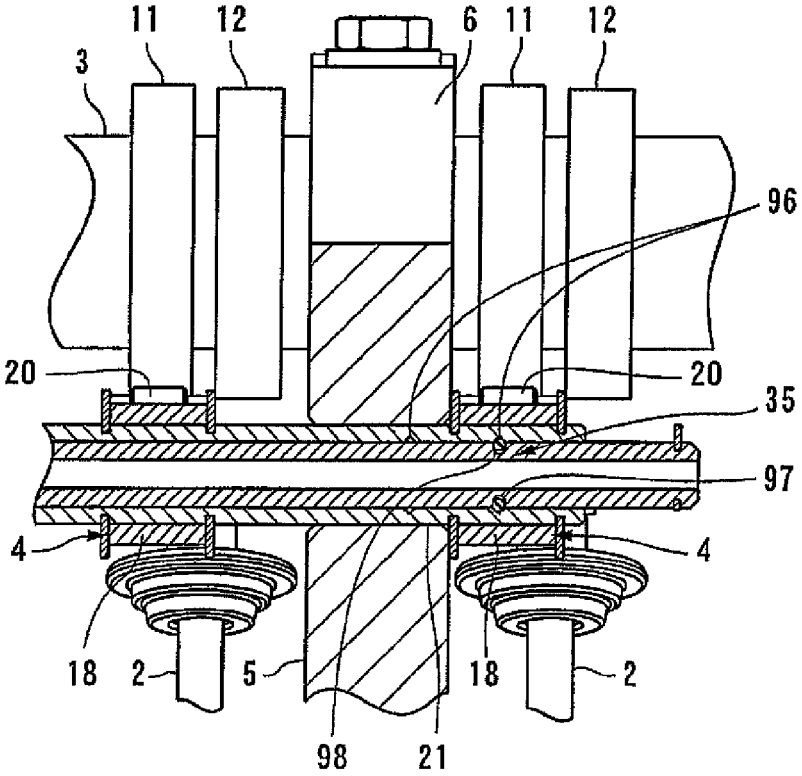
FIG. 15 is a sectional view showing still another preferred embodiment of the holding mechanism.

The holding mechanism can be arranged as shown in FIG. 14 and FIG. 15. In these figures, the same reference numeral is given to the same or equivalent member as in FIG. 1 to FIG. 9B, and a detailed description of the same or equivalent member is omitted.

The holding mechanism 35 according to the present preferred embodiment is arranged by using the rocker shaft 17.

The holding mechanism 35 shown in FIG. 14 includes two dents 91 formed on the outer peripheral surface of the outer rocker shaft 21 and a ball 92 that can enter and leave the dents 91. The outer rocker shaft 21 is used to connect the slider 15 (see FIG. 1 and so forth) of the drive unit 13 and the rocker arm 4 together.

In the present preferred embodiment, each dent 91 is an annular groove that is located on the outer peripheral surface of the outer rocker shaft 21 and that extends in the circumferential direction.

The dents 91 are spaced out at predetermined intervals (pitches) in the axial direction of the outer rocker shaft 21. The interval is equal to the interval (pitch) between two cams that are switched by the valve drive system according to one preferred embodiment of the present invention. These two cams may be a pair of low-speed cam 11 and high-speed cam 12 or may be a pair of active cam and dormant cam.

The ball 92 is movably inserted in a hole 93 defined by the cylinder head 5. The ball 92 is pressed against the dent 91 by a compression coil spring 94 inserted in the hole 93. A bolt 95 to press the compression coil spring 94 against the ball 92 is screwed into the hole 93. The ball 92 is an in-and-out member arranged so as to enter and leave the dent 91 and so as to be fitted into the dent 91.

The holding mechanism 35 shown in FIG. 15 includes two dents 96 located on the inner peripheral surface of the outer rocker shaft 21 and a ring 97 having a shape that can enter and leave the dents 96. Each dent 96 includes an annular groove that is located on the inner peripheral surface of the outer rocker shaft 21 and that extends in the circumferential direction. The dents 96 are spaced out at predetermined intervals (pitches) in the axial direction of the outer rocker shaft 21. The interval is equal to the interval (pitch) between two cams that are switched by the valve drive system according to one of the preferred embodiments of the present invention. These cams may be a pair of low-speed cam 11 and high-speed cam 12 or may be a pair of active cam and dormant cam.

The ring 97 is preferably made of an elastic body. A rubber or a spring can be used as the elastic body, for example. The ring 97 is contained in an annular groove 98 of the inner rocker shaft 23 in a state of protruding from the outer peripheral surface of the inner rocker shaft 23. The ring 97 is an in-and-out member arranged so as to enter and leave the dent 96 and so as to be fitted into the dent 96.

The in-and-out member (the ball 92 or the ring 97) of the holding mechanism 35 shown in FIG. 14 and FIG. 15 restrains the outer rocker shaft 21 from moving in the axial direction. In the holding mechanism 35 of FIG. 14, when a thrust force in the axial direction from the slider 15 is applied to the outer rocker shaft 21, the ball 92 goes out from the dent 91 by the compression of the compression coil spring 94 by elastic deformation. In the holding mechanism 35 of FIG. 15, when a thrust force in the axial direction from the slider 15 is applied to the outer rocker shaft 21, the ring 96 is elastically deformed, and goes out from the dent 96.

In other words, when the thrust force is applied to the outer rocker shaft 21, the in-and-out member (the ball 92, the ring 97) goes out from one of the dents 91 and 96 by the elastic deformation of the elastic member (the compression coil spring 94, the ring 97). The in-and-out member comes off from one of the dents 91 and 96, and, as a result, the outer rocker shaft 21 moves in the axial direction together with the rocker arm 4, and switching between the cams is performed. After completing the switching therebetween, the in-and-out member is fitted into the other one of the dents 91 and 96, and the outer rocker shaft 21 is again restrained from moving in the axial direction.

Therefore, according to the present preferred embodiment, a load in the axial direction is not needed to restrain the slider 15 that has moved from moving in the axial direction, and therefore a slide loss can be restricted. Therefore, according to the present preferred embodiment, the power loss of the engine is reduced.

Figure 16:
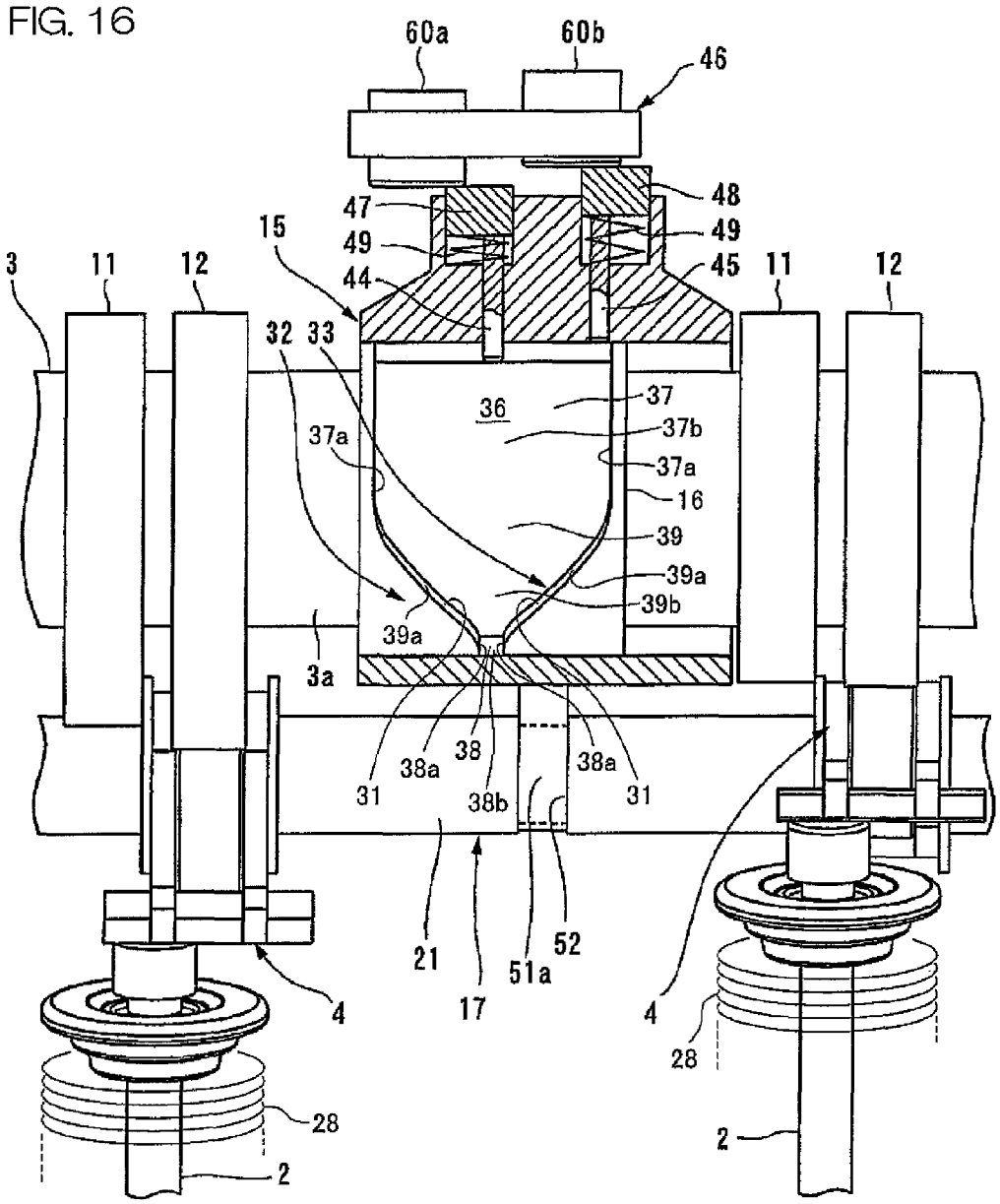
FIG. 16 is a side view showing another preferred embodiment of the cams, and shows the slider illustrated in a sectioned state.

If the holding mechanism 35 having the arrangement shown in FIG. 14 or FIG. 15 is used, the positioning groove 58 is not required to be disposed on the camshaft 3. In this case, the drive units 13 and 14 can be arranged as shown in FIG. 16. In FIG. 16, the same reference numeral is given to the same or equivalent member as in FIG. 1 to FIG. 9B, and a detailed description of the same or equivalent member is omitted.

The switching cam 31 for switching between the first cam mechanism 32 and the second cam mechanism 33 shown in FIG. 16 includes only one cam groove 36 that has a predetermined depth in the radial direction of the camshaft 3. The cam groove 36 includes a wide linear portion 37, a narrow linear portion 38, and a tapered portion 39 that connects these linear portions together. The wide linear portion 37 includes a pair of side walls 37*a* and 37*a* along the circumferential direction of the camshaft 3 and a partially cylindrical bottom surface 37*b* located between the side walls 37*a* and 37*a*. The narrow linear portion 38 includes a pair of side walls 38*a* and 38*a* along the circumferential direction of the camshaft 3 and a partially cylindrical bottom surface 38*b* located between the side walls 38*a* and 38*a*. The tapered portion 39 includes a pair of inclined side walls 39*a* and 39*a* that are inclined in mutually opposite directions with respect to the axial direction of the camshaft 3 and a partially cylindrical bottom surface 39*b* located between the inclined side walls 39*a* and 39*a*. The inclined side wall 39*a* smoothly connects the side wall 37*a* of the wide linear portion 37 and the side wall 38*a* of the narrow linear portion 38 together. The cam followers 44 and 45 are guided from the side wall 37*a* of the wide linear portion 37 to the side wall 38*a* of the narrow linear portion 38 through the inclined side wall 39*a* of the tapered portion 39, and, as a result, the slider 15 moves in the axial direction of the camshaft 3. The slider 15 is supported by both ends of the large diameter portion 16 of the camshaft 3 so as to be movable in the axial direction of the camshaft 3.

The side wall 37*a* of the wide linear portion 37 corresponds to the outer side wall of the linear portion 59 in the arrangement of FIG. 6. The narrow linear portion 38 corresponds to a portion of the positioning groove 58 in the arrangement of FIG. 6 that excludes a range in the circumferential direction in which the movement groove 57 is provided. The side wall 39*a* of the tapered portion 39 corresponds to the outer side wall of the inclined portion 56 in the arrangement of FIG. 6.

Fifth Preferred Embodiment

Figure 17:
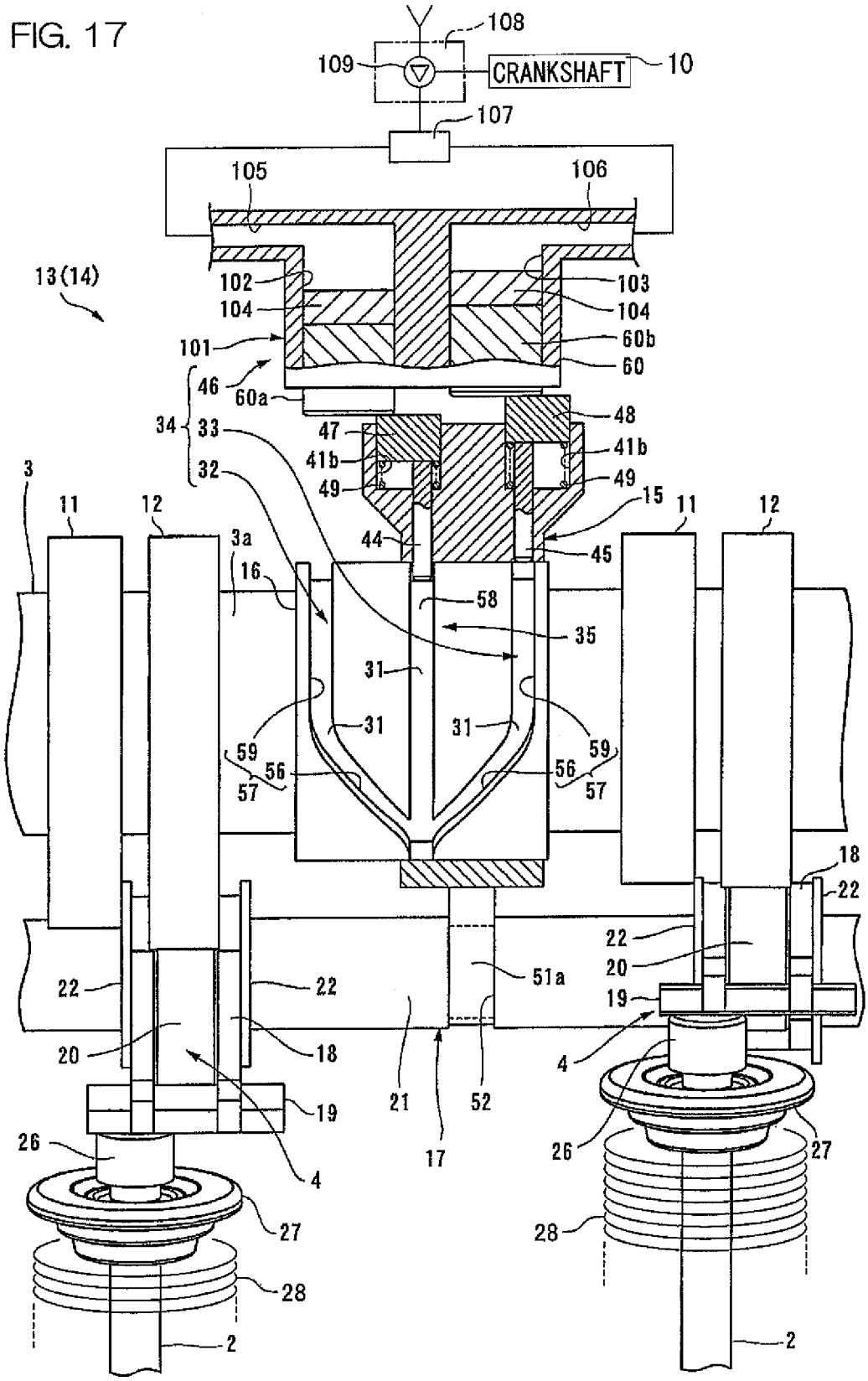
FIG. 17 is a side view showing another preferred embodiment of the actuator, and shows a main portion illustrated in a sectioned state.

A hydraulic power source can be used as the power source of the actuator 46 as shown in FIG. 17. In FIG. 17, the same reference numeral is given to the same or equivalent member as in FIG. 1 to FIG. 9B, and a detailed description of the same or equivalent member is omitted.

The actuator body 60 shown in FIG. 17 preferably includes cylindrical first and second plungers 60*a* and 60*b* that face the lifters 47 and 48, respectively, and a hydraulic cylinder 101 that drives these plungers 60*a* and 60*b*.

The hydraulic cylinder 101 is preferably constructed by fitting pistons 104 into two cylinder holes 102 and 103 defined in the cylinder head 5, respectively. The cylinder holes 102 and 103 are connected to a hydraulic control valve 107 through hydraulic passages 105 and 106, respectively. The hydraulic control valve connects either of the two cylinder holes 102 and 103 to a hydraulic source 108.

The two pistons 104 face the first and second plungers 60*a* and 60*b*, respectively.

The hydraulic source 108 that supplies oil pressure to the hydraulic cylinder 101 includes, for example, a hydraulic pump 109 constructed to discharge oil while rotating together with the crankshaft of the engine. Therefore, the power source of the actuator 46 is never lost during the operation of the engine.

Therefore, according to the present preferred embodiment, it is possible to provide a valve drive system of an engine having a high operational reliability.

Additionally, a conventionally well-known existing one can be used as the hydraulic control valve 107 that controls the operation of the actuator 46. Therefore, a valve drive system according to the present preferred embodiment can be produced without causing a great increase in cost.

Sixth Preferred Embodiment

Figure 18:
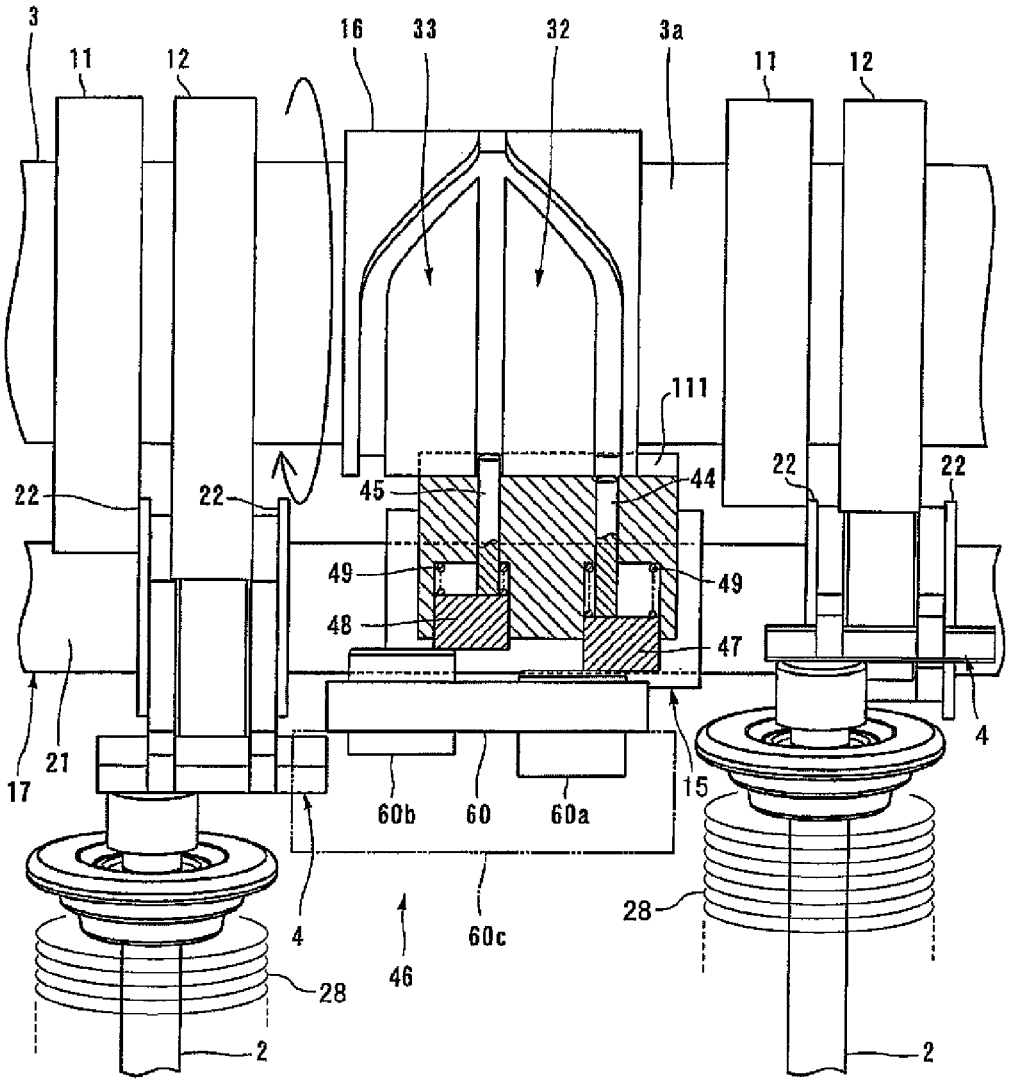
FIG. 18 is a side view showing another preferred embodiment of the slider, and shows a portion of the slider illustrated in a sectioned state.

The slider 15 of the drive unit 13 can also be arranged so as to be supported by the rocker shaft 17 as shown in FIG. 18. In FIG. 18, the same reference numeral is given to the same or equivalent member as in FIG. 1 to FIG. 9B, and a detailed description of the same or equivalent member is omitted.

The slider 15 of the drive unit 13 shown in FIG. 18 is supported by the outer rocker shaft 21 in a state of being unable to relatively move in the axial direction with respect to the rocker shaft 21.

The slider 15 includes a guide portion 111 that comes into contact with the large diameter portion 16 of the camshaft 3 from the outside in the radial direction. The guide portion 111 is arranged so as to prevent the slider 15 from rotating by the rotation of the camshaft 3. The guide portion 111 preferably has a circular-arc shape along the outer peripheral surface of the large diameter portion 16.

Further, in the arrangement according to the present preferred embodiment as well, the same effects and advantages as in the preferred embodiments shown in FIGS. 1 to 9B can be attained.

Although a non-limiting example in which the present invention is applied to a multi-cylinder engine has been described in the above preferred embodiments, the present invention is applicable to a single-cylinder engine. Additionally, although a non-limiting example in which switching between two cams is performed has been described in the above preferred embodiments, the number of cams to be switched is not limited to two, and switching among three or more cams can be performed in the valve drive system according to various preferred embodiments of the present invention. For example, in a case that switching among three cams is desired, the number of switching cams 31 and the number of cam followers are increased, accordingly.

Although the preferred embodiments of the present invention have been described in detail as above, these are merely specific examples used to clarify the technical contents of the present invention, and the present invention should not be understood as being limited thereto, and the scope of the present invention is to be determined solely by the appended claims.

The present application corresponds to Japanese Patent Application No. 2009-232203 filed in the Japan Patent Office on Oct. 6, 2009, and the entire disclosure of which is incorporated herein by reference.

The invention claimed is:

1. A valve drive system of an engine, the valve drive system comprising:

a camshaft that is supported by a cylinder head of the engine and on which a plurality of cams having different valve lift characteristics are arranged at predetermined intervals;

a rocker shaft supported by the cylinder head in parallel or substantially in parallel with the camshaft;

a rocker arm that is disposed between one of the plurality of cams and an intake valve or an exhaust valve, that is swingably supported by the rocker shaft, and that is movable in an axial direction of the rocker shaft, the rocker arm including a presser for the intake valve or the exhaust valve and extending in the axial direction for a length greater than the predetermined interval between the plurality of cams; and a drive unit that moves the rocker arm toward one side or toward an opposite side in the axial direction by the predetermined interval between the plurality of cams; wherein the drive unit includes:

a slider that is movable in the axial direction of the camshaft;

a connecting mechanism that connects the slider and the rocker arm; and a cam mechanism, including a switching cam integral with the camshaft, that transforms rotation of the camshaft into a thrust force toward the one side or toward the opposite side in the axial direction of the camshaft using the switching cam so as to move the slider in the axial direction of the camshaft with the thrust force.

2. The valve drive system of the engine according to claim 1, wherein the drive unit is supported by an element other than the rocker arm.

3. The valve drive system of the engine according to claim 1, wherein the cam mechanism generates the thrust force to move the slider in the axial direction when amounts of valve lifts of the plurality of cams are 0.

4. A valve drive system of an engine, the valve drive system comprising:

a camshaft that is supported by a cylinder head of the engine and on which a plurality of cams having different valve lift characteristics are arranged at predetermined intervals;

a rocker shaft supported by the cylinder head in parallel or substantially in parallel with the camshaft;

a rocker arm that is disposed between one of the plurality of cams and an intake valve or an exhaust valve, that is swingably supported by the rocker shaft, and that is movable in an axial direction of the rocker shaft, the rocker arm including a presser for the intake valve or the exhaust valve and extending in the axial direction for a length greater than the predetermined interval between the plurality of cams; and a drive unit that moves the rocker arm toward one side or toward an opposite side in the axial direction by the predetermined interval between the plurality of cams; wherein the drive unit includes:

a driving mechanism that transforms rotation of the camshaft into a thrust force toward the one side or toward the opposite side in the axial direction of the camshaft;

a slider that is driven by the driving mechanism to move in the axial direction of the camshaft;

a connecting mechanism that connects the slider and the rocker arm; and a holding mechanism that holds the slider at a position to which the slider has moved; wherein the driving mechanism includes:

a first cam mechanism that moves the slider toward the one side in the axial direction when amounts of valve lifts of the plurality of cams are 0;

a second cam mechanism that moves the slider toward the opposite side in the axial direction when amounts of valve lifts of the plurality of cams are 0; and an actuator that performs switching between a use state and a non-use state of the first and second cam mechanisms; wherein a movement distance of the slider moved by the first and second cam mechanisms is equal to the predetermined interval between the plurality of cams.

5. The valve drive system of the engine according to claim 4, wherein each of the first cam mechanism and the second cam mechanism includes:

a switching cam including a cam groove that has a predetermined depth in a radial direction of the camshaft and that extends in a circumferential direction and in the axial direction of the camshaft; and a cam follower arranged to be guided by the switching cam; wherein the actuator is arranged to reciprocate the cam followers of the first and second cam mechanisms between a use position at which the cam followers are guided when in contact with the switching cam and a non-use position at which the cam followers are apart from the switching cam outwardly in the radial direction;

the slider is supported by a portion of the camshaft at which the switching cam is arranged rotatably relative to the camshaft, and is held such that rotation around the camshaft is restrained by the connecting mechanism; and the cam followers of the first and second cam mechanisms are movably supported by the slider.

6. The valve drive system of the engine according to claim 5, wherein the connecting mechanism is arranged to transmit a thrust force from the slider to the rocker arm through the rocker shaft.

7. The valve drive system of the engine according to claim 6, wherein the rocker shaft includes:

a first rocker shaft that moves in an axial direction together with the slider and the rocker arm; and a second rocker shaft located coaxially with the first rocker shaft and relatively movable in the axial direction with respect to the first rocker shaft; wherein the first rocker shaft is joined to the rocker arms corresponding to a plurality of cylinders of the engine so that the thrust force is transmitted thereto; and the first cam mechanism and the second cam mechanism are arranged to generate a thrust force by which the slider is moved when amounts of valve lifts become 0 in the plurality of cylinders.

8. The valve drive system of the engine according to claim 5, wherein the actuator includes:

a lifter for each cam follower, the lifter being attached to a front end of the cam follower and being supported to enter and leave the slider;

a spring member that presses the lifter in a direction in which the lifter leaves the slider; and an actuator body that faces the lifter; wherein the actuator body is supported by a cylinder head or a head cover of the engine; and the actuator body includes a plurality of plungers that proceed to and recede from the lifter.

9. The valve drive system of the engine according to claim 5, wherein the switching cam includes:

a movement groove that includes an inclined portion used to move the slider in the axial direction; and an annular positioning groove that extends in a circumferential direction of the camshaft at a same position in the axial direction as a terminal of the inclined portion; wherein the holding mechanism includes the annular positioning groove and the cam follower.

10. The valve drive system of the engine according to claim 7, wherein the annular positioning groove of the first cam mechanism and the annular positioning groove of the second cam mechanism are located at a same position in the axial direction.

11. The valve drive system of the engine according to claim 9, wherein a depth of the annular positioning groove is equal to or greater than a depth of the movement groove.

12. The valve drive system of the engine according to claim 4, wherein the rocker shaft includes:

an outer rocker shaft that is pipe-shaped and to which the rocker arm is attached; and an inner rocker shaft that is movably fitted to an inside of the outer rocker shaft; wherein the connecting mechanism is arranged to transmit a thrust force from the slider to the rocker arm through the outer rocker shaft; and the holding mechanism includes:

a dent located on an outer surface or on an inner surface of the outer rocker shaft; and an in-and-out member that is arranged to be able to go in and out of the dent and to be pressed against the dent by elasticity.

13. The valve drive system of the engine according to claim 4, wherein a power source of the actuator is an electrically-operated driving source.

14. The valve drive system of the engine according to claim 13, wherein the actuator is arranged such that, in an OFF state, one of the first and second cam mechanisms reaches a use state, and a remaining one of the first and second cam mechanisms reaches a non-use state.

15. The valve drive system of the engine according to claim 4, wherein a power source of the actuator is a hydraulic driving source.

* * * * *